US007537661B2

(12) United States Patent
Nakagawa et al.

(10) Patent No.: US 7,537,661 B2
(45) Date of Patent: May 26, 2009

(54) LIQUID APPLYING APPARATUS AND INK-JET PRINTING APPARATUS

(75) Inventors: Yoshinori Nakagawa, Kawasaki (JP); Osamu Iwasaki, Tokyo (JP); Atsuhiko Masuyama, Tokyo (JP); Naomi Oshio, Kawasaki (JP); Naoji Otsuka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 460 days.

(21) Appl. No.: 11/499,720

(22) Filed: Aug. 7, 2006

(65) Prior Publication Data

US 2007/0034152 A1 Feb. 15, 2007

(30) Foreign Application Priority Data

Aug. 11, 2005 (JP) ..... 2005-233271

(51) Int. Cl.
*B05C 1/08* (2006.01)

(52) U.S. Cl. ..... 118/708; 118/712; 118/600; 118/602; 118/259; 347/103

(58) Field of Classification Search ..... 118/663, 118/688, 708, 712, 600, 602, 249, 256, 259, 118/261, 262; 427/8, 333, 340, 345, 356, 427/428.18; 347/2, 85, 101, 103, 105; 101/416.1, 101/417, 419, 424.2
See application file for complete search history.

(56) References Cited

U.S. PATENT DOCUMENTS

| | | | | |
|---|---|---|---|---|
| 5,850,233 | A | 12/1998 | Otsuka et al. | 346/136 |
| 6,142,600 | A | 11/2000 | Takahashi et al. | 347/23 |
| 6,183,079 | B1 | 2/2001 | Meade et al. | |
| 6,423,366 | B2 * | 7/2002 | Falck et al. | 427/8 |
| 2003/0024474 | A1 * | 2/2003 | Suzuki et al. | 118/258 |
| 2005/0174380 | A1 | 8/2005 | Ide et al. | 347/19 |
| 2005/0179720 | A1 | 8/2005 | Iwasaki et al. | 347/19 |
| 2006/0144268 | A1 * | 7/2006 | Isono et al. | 101/350.5 |
| 2006/0176325 | A1 | 8/2006 | Seki et al. | 347/7 |
| 2007/0034102 | A1 | 2/2007 | Oshio et al. | 101/348 |
| 2007/0035592 | A1 | 2/2007 | Oshio et al. | 347/84 |
| 2007/0035593 | A1 | 2/2007 | Iwasaki et al. | 347/85 |
| 2007/0070163 | A1 | 3/2007 | Masuyama et al. | 347/104 |
| 2007/0126835 | A1 | 6/2007 | Oshio et al. | 347/103 |

(Continued)

FOREIGN PATENT DOCUMENTS

| | | |
|---|---|---|
| JP | 8-58069 | 3/1996 |

(Continued)

*Primary Examiner*—Laura Edwards
(74) *Attorney, Agent, or Firm*—Fitzpatrick, Cella, Harper & Scinto

(57) ABSTRACT

When it is determined that an end process flag is not stored in memory, there is a possibility that the recovery operation was not executed normally and the viscosity increased or fixed coating liquid exist in a liquid holding member and liquid flow paths. Therefore, a filling operation for generating stronger fluidization than a normal filling operation is carried out as a filling operation also acting as a restoration operation. That is, a pump is operated at a predetermined rotating speed for a specified time, which is longer than the specified time for the normal filling operation. By this, the viscosity increased coating liquid existing in the liquid holding space and the respective liquid flow paths is re-fluidized to an extent that will not interfere with circulation, and normal filling of the coating liquid is carried out.

11 Claims, 25 Drawing Sheets

U.S. PATENT DOCUMENTS

2007/0126836 A1 6/2007 Masuyama et al. ..... 347/103

FOREIGN PATENT DOCUMENTS

JP 8-72227 3/1996
JP 2001-70858 3/2001
JP 2002-96452 4/2002
JP 2002-517341 6/2002

* cited by examiner

LIQUID APPLYING APPARATUS AND INK-JET PRINTING APPARATUS

BACKGROUND OF THE INVENTION

1. Field of the Invention

The present invention relates to a liquid applying apparatus and an ink-jet printing apparatus. More specifically, the present invention relates to a liquid applying apparatus for coating a medium with a liquid for a predetermined purpose such as facilitating coagulation of pigments when ink-jet printing with ink having the pigments as color material or the like. Also, the present invention relates to an ink-jet printing apparatus provided with a mechanism for applying a liquid to a printing medium for a purpose of facilitating coagulation of pigments at printing with ink having the pigments as color material.

2. Description of the Related Art

As a method for widely applying a liquid or a liquid material to a medium, a spin coater, a roll coater, a bar coater and a die coater are known. These coating methods assume continuous coating on a coating medium with a relatively long length in the conveying direction. Therefore, for example, if a coating medium with a relatively small size is intermittently conveyed for coating, a problem might occur that a uniform coated film can not be obtained because a coating bead is disturbed at the coating start or end position of each coating medium.

As a configuration to solve the above problem, an apparatus described in Japanese Patent Application Laid-open No. 2001-070858 is known. In this configuration, a rotating rod bar is used in the dye coater method to discharge paint from a discharge slit to the rod bar and form a coated film on the rod bar. Then, the formed coated film comes in contact with a coating medium so that the coated film is transferred to the coating medium with rotation of the rod bar. When the coated film formed on the rod bar is not transferred to coat the coating medium, the paint is returned into a head by rotation of the rod bar and recovered through a collection slit. That is, the rod bar keeps on rotating even if a coating operation is not performed, and at that time, the paint is in the state forming a coated film on the rod bar. By this, even if the coating medium is supplied intermittently and coating is performed on them intermittently, uniform coated films can be obtained.

A device using a liquid applying mechanism is also known in a field of an ink-jet printing apparatus. Japanese Patent Application Laid-open No. 2002-517341 discloses use of a doctor blade in contact with a roller so that a coating liquid is recovered between this blade and the roller and the coating liquid is applied to this roller in response to rotation of the roller. And in response to the rotation of the roller, the coating liquid applied to the roller is transferred to be applied to a support body conveyed between this and another rollers. Japanese Patent Application Laid-open No. 8-072227 (1996) also discloses a mechanism in an ink-jet printing apparatus for applying a treatment liquid to insolubilize a dye in advance before printing. An embodiment 1 of this document describes that the treatment liquid in a replenishment tank is drawn out by attached to a rotating roller and at the same time, the drawn treatment liquid is applied to a printing paper.

However, in any of the configurations described in the above Japanese Patent Application Laid-open No. 2001-070858, Japanese Patent Application Laid-open No. 2002-517341, and Japanese Patent Application Laid-open No. 8-072227 (1996), a coating liquid is applied or supplied to the surface of a bar or a roller while the rod bar or the roller is rotating, and a portion to which the coating liquid is applied is open to or communicates with the atmosphere. Therefore, vaporization of the coating liquid may cause a problem and when the attitude of the apparatus is changed, that might cause a problem of leakage of the coating liquid. Particularly, in an ink-jet printing device as a printer, considering leakage of a liquid due to attitude change during transportation, the coating mechanisms described in the above each document are hard to be employed to a small-sized apparatus.

On the other hand, a configuration that a portion of a roller to which an ink as a coating liquid is applied or supplied is sealed is disclosed in Japanese Patent Application Laid-open No. 8-058069 (1996). The coating mechanism described in this document is a mechanism for applying ink to a roller having a surface on which a pattern of a printing plate is formed in a gravure printing device. Here, a chamber member is used having doctor blades extending in the longitudinal direction of the roller at positions corresponding to upper and lower two locations along a circumferential surface of the roller and elastic members provided respectively at both ends of these two doctor blades. By bringing the chamber member into contact with the circumferential surface of the roller, a liquid chamber is formed between the chamber member and the roller. And when the roller is rotated, the coating liquid in the liquid chamber is applied or supplied to the roller.

In the coating apparatuses as described in the above Japanese Patent Application Laid-open No. 2001-070858, Japanese Patent Application Laid-open No. 2002-517341, Japanese Patent Application Laid-open No. 8-072227 (1996) and Japanese Patent Application Laid-open No. 8-058069 (1996), a problem might occur which is caused by that the liquid for coating is kept at a certain location in the apparatus and does not flow for a relatively long time. For example, if a coating operation is not performed for a relatively long time, the coating liquid remaining on the surface of the coating roller may become thick, and thus when the coating operation start again, the roller may not rotate normally or a medium can not be coated uniformly with the liquid.

For these problems, Japanese Patent Application Laid-open No. 2002-096452 describes that coating initial process, which is an operation to rotate a coating roller without a medium at a power on the apparatus or every predetermined time during standby for a printing operation in the printing apparatus employing a coating liquid. More specifically, when the coating roller is rotated without the medium, the coating liquid attached to the coating roller is refreshed, and thus viscosity of the coating liquid on the coating roller can be lowered. In this way, according to Japanese Patent Application Laid-open No. 2002-096452, even if the coating liquid on the coating roller has had high viscosity, the viscosity can be lowered or the coating liquid of increased viscosity can be eliminated, which enables the subsequent coating operation to be performed well.

However, in the Japanese Patent Application Laid-open No. 2002-096452, aviscosity increase of the coating liquid on the coating roller is recognized as a problem, but a viscosity increase of the coating liquid in a flow path for supplying the coating liquid to the coating roller is not recognized as a problem. More specifically, in a form for supplying the coating liquid from a reservoir tank of the coating liquid to the coating roller via the flow path, the coating liquid in the flow path is evaporated when a non-operating state lasts for a long time, and thus the coating liquid becomes high viscous or is fixed, in the flow path. In order to reduce this viscosity increase or fixation, it is desirable to recover the coating liquid from the flow path before the non-operating state lasts for a long time. However, Japanese Patent Application Laid-open No. 2002-096452 does not describe such a recovering operation of the coating liquid. Moreover, Japanese Patent Application Laid-open No. 2001-070858, Japanese Patent Application Laid-open No. 2002-517341, Japanese Patent Application Laid-open No. 8-072227 (1996) and Japanese Patent Application Laid-open No. 8-058069 (1996) do not describe the recovering of the coating liquid before the non-operating state lasts for a long-time, either.

If the coating liquid can be surely recovered before the non-operating state lasts for a long time, the problem of the viscosity increase or the fixation of the coating liquid in the flow path does not become apparent. However, in the case of unintentional stop of operations of an apparatus due to outage or the like, the apparatus is powered off without performing the above recovering operation. In this case, the coating liquid remains in the flow path for a long time, and the remaining coating liquid may cause the viscosity increase or the fixation in the flow path. Because of this, in some cases the subsequent coating operation can not be performed well.

Also, the problem of the viscosity increase or the fixation when the recovering operation is not performed does not occur only in the flow path. If the recovering operation is not performed, the liquid is left in contact with the coating roller for a long time. As a result, the viscosity increase or the fixation of the liquid will occur on the surface of the coating roller and cause a problem of uneven coating or the like.

SUMMARY OF THE INVENTION

An object of the present invention is to provide a liquid applying apparatus and an ink-jet printing apparatus which can perform a coating operation well even after the coating liquid can not be recovered from a liquid flow path and the like before a non-operating state lasts for a long time.

In the first aspect of the present invention, there is provided a liquid applying apparatus comprising:

an applying unit which includes a coating member for applying a liquid to a medium and a liquid holding member for holding the liquid in a condition that the liquid contacts with a part of the coating member, and causes the coating member to rotate so as to apply the liquid held by the liquid holding member to the medium through the coating member;

a reservoir which stores the liquid;

a path which makes the reservoir and the liquid holding member communicated with each other;

a recovering unit which recovers the liquid from a flow passage including the path and the liquid holding member to the reservoir;

a storage unit which stores information indicating that a recovering operation has been executed by the recovering unit; and a preparation operation executing unit which executes as a preparation operation executed before applying operation by the applying unit, at least one of a supplying operation in which the liquid is supplied from the reservoir to the liquid holding member through the path and a rotation operation in which the coating member is rotated, wherein the preparation operation executing unit changes a mode of the preparation operation in accordance with a judgment whether the information indicating that a recovering operation has been executed is stored in the storage unit.

In the second aspect of the present invention, there is provided a liquid applying apparatus comprising:

an applying unit which includes a coating member for applying a liquid to a medium and a liquid holding member for holding the liquid in a condition that the liquid contacts with a part of the coating member, and causes the coating member to rotate so as to apply the liquid held by the liquid holding member to the medium through the coating member;

a reservoir which stores the liquid;

a first path for supplying the liquid stored in the reservoir to the liquid holding member;

a second path for recovering the liquid from liquid holding member to the reservoir;

a recovering unit which recovers the liquid from a flow passage including the first, second paths and the liquid holding member to the reservoir;

a storage unit which stores information indicating that a recovering operation has been executed by the recovering unit; and an executing unit which executes a supplying operation in which the liquid is supplied from the reservoir to the liquid holding member through the first path, before applying operation by the applying unit, wherein the executing unit changes a mode of the supplying operation in accordance with a judgment whether the information indicating that a recovering operation has been executed is stored in the storage unit.

In the third aspect of the present invention, there is provided a liquid applying apparatus comprising:

an applying unit including a coating member for applying a liquid to a medium and a liquid holding member for holding the liquid in a condition that the liquid contacts with a part of the coating member, and causing the coating member to rotate so as to apply the liquid held by the liquid holding member to the medium through the coating member;

a reservoir which stores the liquid;

a first path for supplying the liquid stored in the reservoir to the liquid holding member;

a second path for transferring the liquid held in the liquid holding member to the reservoir;

a recovering unit which recovers the liquid from a flow passage including the first, second paths and the liquid holding member to the reservoir;

a storage part unit which stores information indicating that a recovering operation has been executed by the recovering unit; and an executing unit which executes a rotating operation in which the coating member is rotated, before applying operation by the applying unit, wherein the executing unit changes a mode of the rotating operation in accordance with a judgment whether the information indicating that a recovering operation has been executed is stored in the storage unit.

In the fourth aspect of the present invention, there is provided a liquid applying apparatus comprising:

an applying unit which includes a coating member for applying a liquid to a medium and a liquid holding member for holding the liquid in a condition that the liquid contacts with a part of the coating member, and causes the coating member to rotate so as to apply the liquid held by the liquid holding member to the medium through the coating member;

a reservoir which stores the liquid;

a path which makes the reservoir part and the liquid holding member communicated with each other;

a recovering unit which recovers the liquid from a flow passage including the path and the liquid holding member to the reservoir;

a storage unit which stores information indicating that a recovering operation has been executed by the recovering unit; and a preparation operation executing unit which executes a predetermined preparation operation before applying operation by the applying unit if the information indicating that a recovering operation has been executed is not stored in the storage unit, wherein the predetermined preparation operation is one of (A) a supplying operation in which the liquid is supplied from the reservoir to the liquid holding member through the path and (B) a rotation operation in which the coating member is rotated.

According to the present invention, modes of a preparation operation such as filling operation, roller rotating operation and the like are differentiated according to a judgment whether information showing that a liquid has been recovered is stored. For example, if the recovering operation is not performed unintentionally due to power-off of the apparatus or the like, a stronger preparation operation than the case where the recovering operation is performed is carried out to reduce viscosity increased or fixed objects in the flow path or on the coating roller. As a result, even if the recovering operation is not surely performed, the coating operation subsequently performed can be carried out well.

Further features of the present invention will become apparent from the following description of exemplary embodiments (with reference to the attached drawings).

DESCRIPTION OF THE EMBODIMENTS

Figure 1:
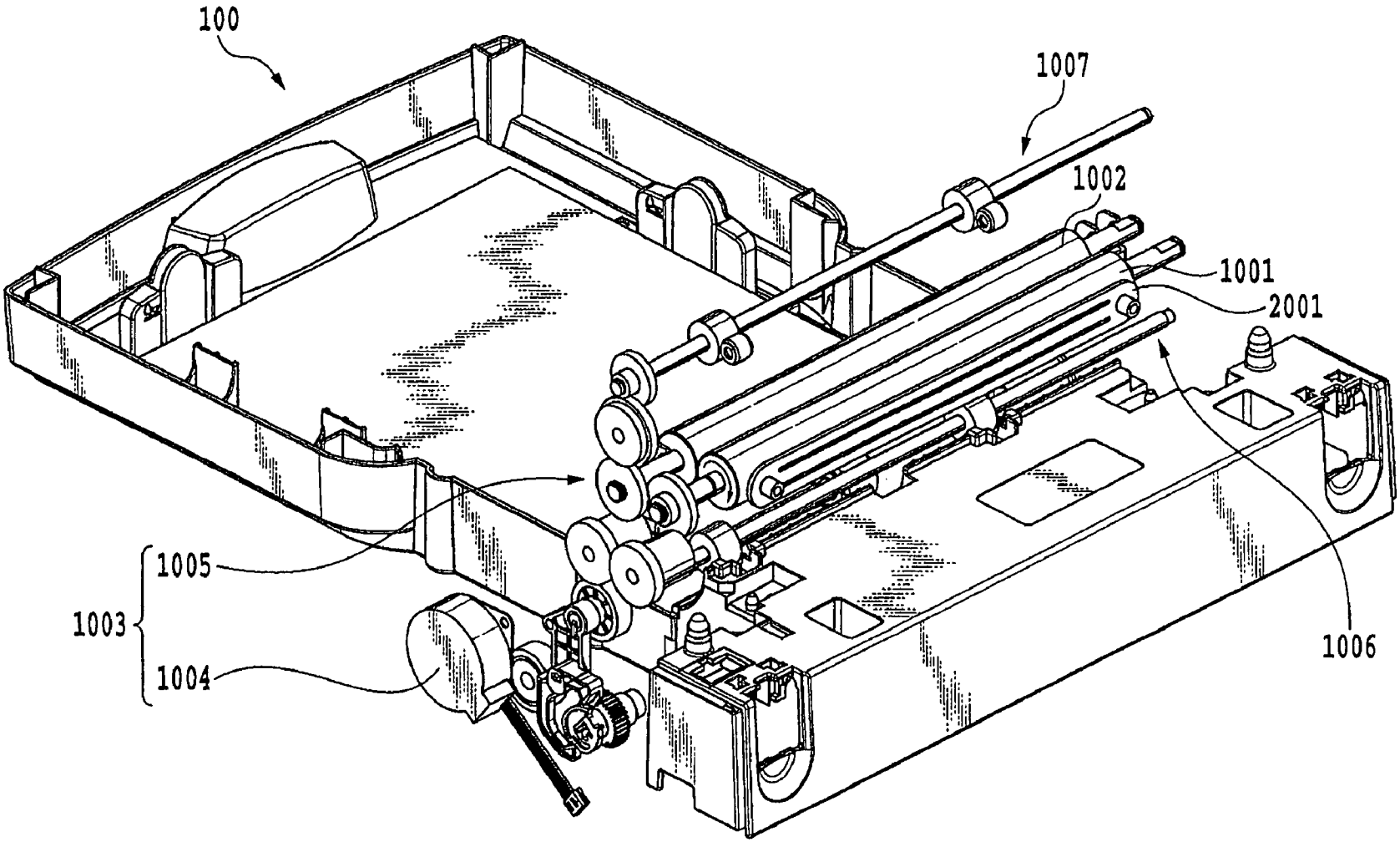
FIG. 1 is a perspective view showing an entire configuration of an embodiment according to a liquid applying apparatus of the present invention.

Embodiments of the present invention will be described in detail referring to the drawings.

First Embodiment

FIG. 1 is a perspective view showing an entire configuration of an embodiment of a liquid applying apparatus 100 according to the present invention. The liquid applying apparatus 100 shown herein is roughly configured to have a liquid applying mechanism for applying a predetermined applying liquid (also referred to as coating liquid hereinafter) to an applying medium (also referred to as coating medium hereinafter) and a liquid supplying mechanism for supplying the coating liquid to the liquid applying mechanism.

The liquid applying mechanism has a cylindrical applying roller (also referred to as coating roller hereinafter) 1001, a cylindrical counter roller (medium support member) 1002 arranged opposite to the coating roller 1001, and a roller driving mechanism 1003 for driving the coating roller 1001, or the like. The roller driving mechanism 1003 is composed of a roller driving motor 1004 and a power transmission mechanism 1005 having a gear train for transmitting a driving force of this roller driving motor 1004 to the coating roller 1001.

Moreover, the liquid supplying mechanism is configured by having a liquid holding member 2001 for holding a coating liquid between itself and the circumferential surface of the coating roller 1001, and a liquid flow path 3000 (not shown in FIG. 1), which will be described later, for supplying the liquid to the liquid holding member 2001. The coating roller 1001 and the counter roller 1002 are rotatably supported by shafts in parallel with each other, which respective both ends are rotatably mounted to a frame, not shown. Moreover, the liquid holding member 2001 extends over substantially the whole length of the coating roller 1001 in the longitudinal direction and is movably mounted to the above frame via a mechanism capable of approach/separation with respect to the circumferential surface of the coating roller 1001.

The liquid applying apparatus of the embodiment is further provided with a coating medium supplying mechanism 1006 composed of a pickup roller and the like for conveying the coating medium to a nip portion between the coating roller 1001 and the counter roller 1002. Moreover, in a conveying path of the coating medium, a paper discharge mechanism 1007 composed of a paper discharge roller and the like for conveying the coating medium on which the coating liquid has been applied to a paper discharge portion (not shown) is provided on the down stream side of the coating roller 1001 and the counter roller 1002. These paper feed mechanism and paper discharge mechanism are operated by a driving force of the driving motor 1004 transmitted via the power transmission mechanism 1005 as well as the coating roller or the like.

An example of components of the coating liquid used in the embodiment is described below:

Calcium nitrate tetrahydrate: 10%

Glycerin: 42%

Surfactant: 1%

Water: remaining amount

The viscosity of the above coating liquid is 5 to 6 cP (centipoise) at 25° C.

It is needless to say that the coating liquid in application of the present invention is not limited to the above. For example, a liquid containing a component to insolubilize or coagulate a dye can be used as another coating liquid. Alternatively, a liquid containing a component to suppress curl (phenomenon that the medium is brought into a curved shape) of the coating medium can also be used as another coating liquid.

When water is used in a liquid to be applied, slidability between the coating roller and the contact portion of the liquid holding member is made better by adding a component to lower surface tension to the liquid.

In the above example of components of the coating liquid, glycerin and surfactant are components to lower the surface tension of water.

Next, components of each portion configuring the liquid applying apparatus roughly described above will be explained in detail.

Figure 2:
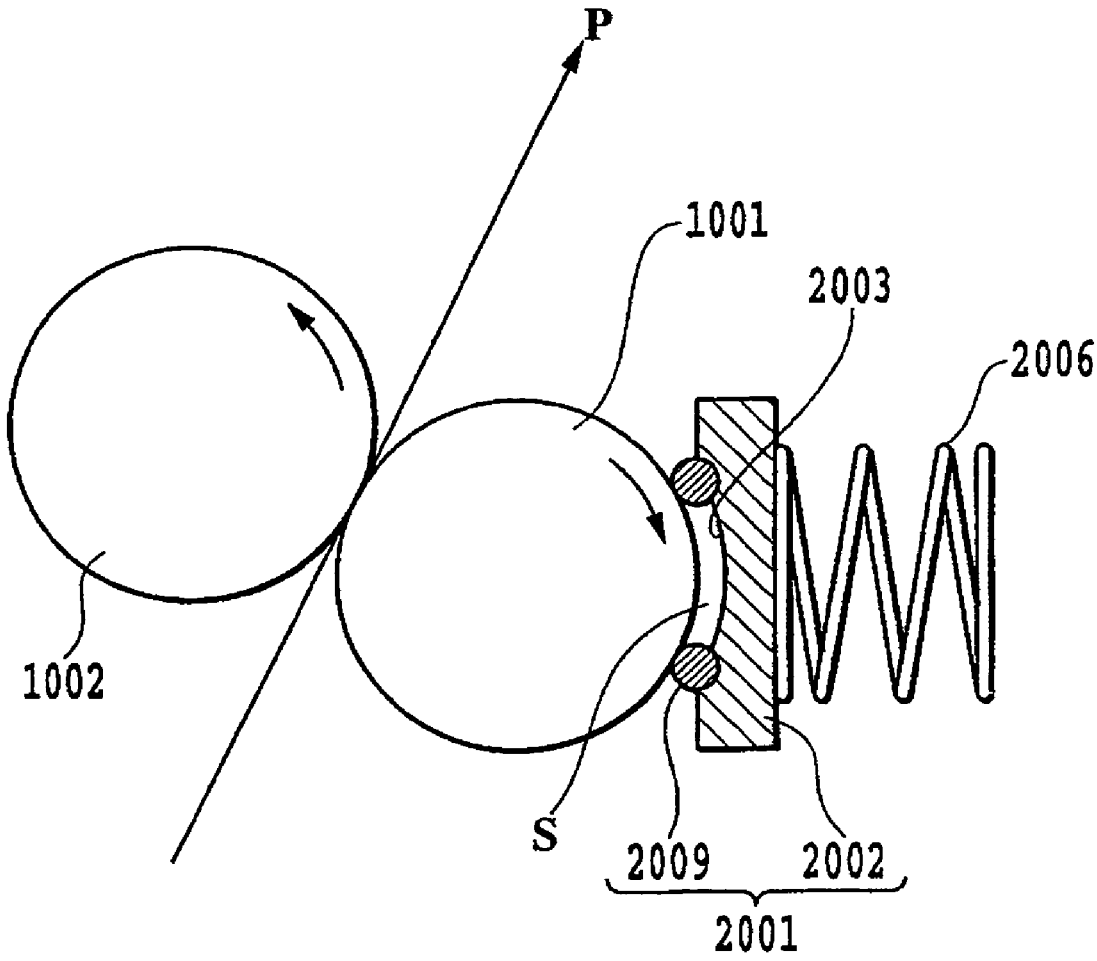
FIG. 2 is a side sectional view showing an example of arrangement of a coating roller, a counter roller and a liquid holding member shown in FIG. 1.

FIG. 2 is a side sectional view showing a detail arrangement of the coating roller 1001, the counter roller 1002 and the liquid holding member 2001.

The counter roller 1002 is biased toward the circumferential surface of the coating roller 1001 by a biasing mechanism, not shown, configured by having a spring or the like. By rotating the coating roller 1001 clockwise in this state in the figure, a printing medium P to which the coating liquid is to be applied can be held between the both rollers and can be conveyed in the arrow direction in the figure.

In this embodiment, the material of the coating roller 1001 is EPDM having rubber hardness of 30 degrees, with the surface roughness of Ra 1.6 μm and the diameter of 22.19 mm. The material of the counter roller 1002 is aluminum and its surface is machined in the mirror surface state with the diameter of 22.19 mm.

The liquid holding member 2001 is configured to have a space forming member 2002 and a contact member 2009 and is biased toward the circumferential surface of the coating roller 1001 by the biasing force of the spring 2006, to contact with the coating roller. By this contact, a long liquid holding space (liquid holding portion) S extending over the whole liquid applying area (in the direction perpendicular to the paper surface in FIG. 2) by the coating roller 1001 is formed. In this liquid holding space S, the coating liquid is supplied from a liquid flow path 3000, which will be described later, via the supply port of the liquid holding member 2001. In this case, since the liquid holding member 2001 is configured as follows, unintentional leakage of the coating liquid from the liquid holding space S to the outside can be prevented while the coating roller 1001 is stopped.

A configuration of the liquid holding member 2001 is shown in FIGS. 3 to 8.

Figure 3:
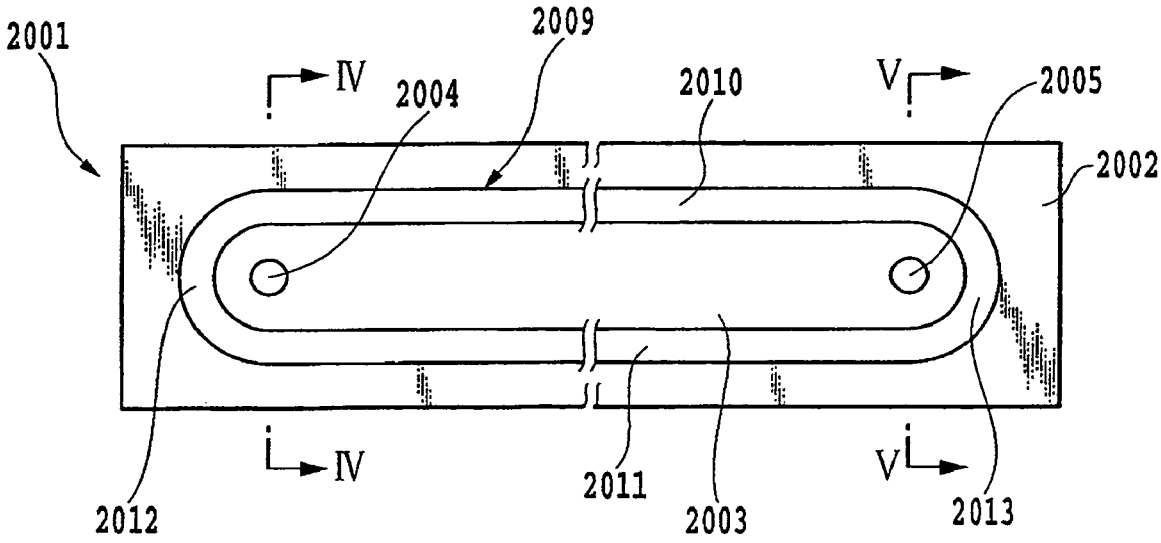
FIG. 3 is an elevation view of the liquid holding member shown in FIGS. 1 and 2.

As shown in FIG. 3, the liquid holding member 2001 is configured to have the space forming member 2002 and the annular contact member 2009 provided on the surface of the space forming member 2002. In the space forming member 2002, a recess portion 2003 cross section profile of which has an arc is formed along the longitudinal direction at the center. The contact member 2009 has straight portions 2010, 2011 which are fixed along the respective straight edge portions of the recess portion 2003, and circumference portions 2012, 2013 which are fixed in a state that each of the portions 2012, 2013 extends from upper one of the edge portions through the recess portion to the similar straight edge portion on the opposite side. By this configuration, when the contact portion 2009 of the liquid holding member 2001 is brought into contact with the coating roller 1001, contact along the circumferential surface shape of the coating roller is made possible, which can realize contact with a uniform pressure.

In this preferred embodiment, the material of the contact member 2009 is NBR (nitryl butadiene rubber) with the hardness of 70 degrees and the diameter of 3.5 mm.

As described above, the contact member 2009 of the liquid holding member in this embodiment is formed integrally without seams and thus is brought into contact with the outer circumferential surface of the coating roller 1001 continuously without a gap by the biasing force of the spring member 2006. As a result, the liquid holding space S becomes a space substantially blocked by the contact member 2009, one surface of the space forming member and the outer circumferential surface of the coating roller 1001 and the coating liquid is held in this space. In the state where rotation of the coating roller 1001 is stopped, the contact member 2009 and the outer circumferential surface of the coating roller 1001 maintain a liquid tight state, by which leakage of the liquid to the outside can be surely prevented. On the other hand, when the coating roller 1001 is rotated, as will be described later, the coating liquid passes between the outer circumferential surface of the coating roller 1001 and the contact member 2009 and adheres to the outer circumferential surface of the coating roller in a layered state. Here, the close contact state between the outer circumferential surface and the contact member 2009 when the coating roller 1001 is stopped means that, as mentioned above, a liquid is prevented from passing between the inside and the outside of the above liquid holding space S. In this case, the contact state of the contact member 2009 is such that the contact member is in direct contact with the outer circumferential surface of the coating roller 1001 and also includes a state that the contact member is brought into contact with the above outer circumferential surface through a liquid film formed by a capillary force.

Figure 6:
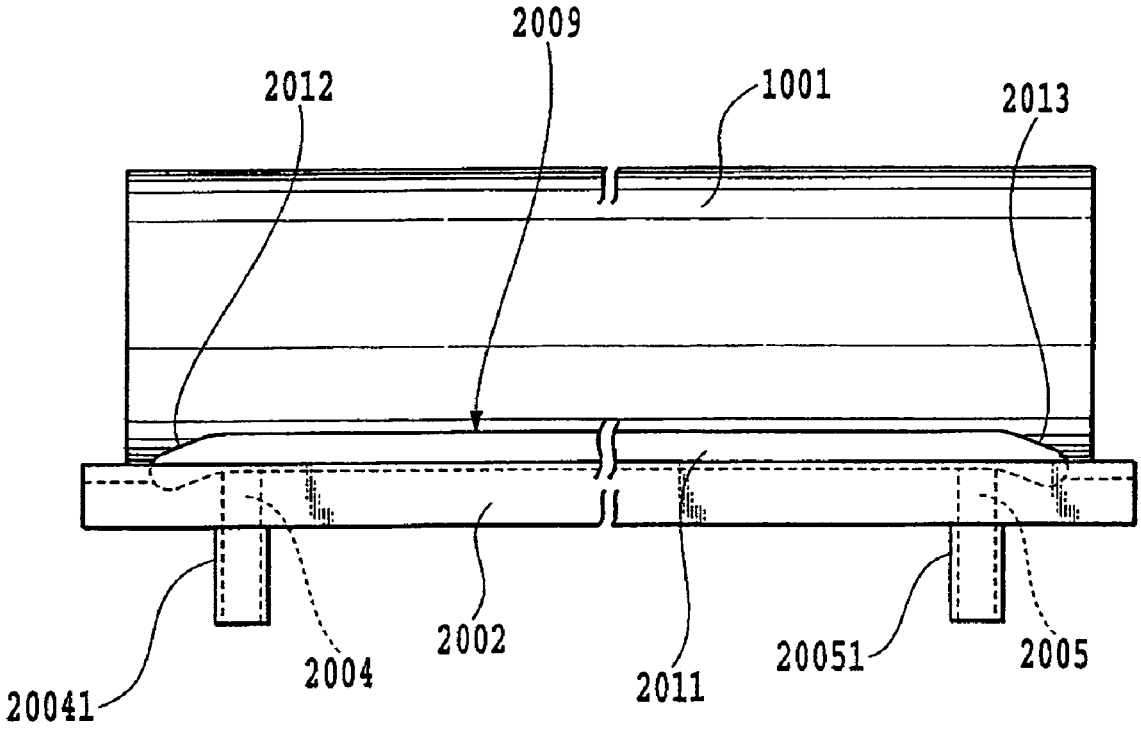
FIG. 6 is a plan view of the liquid holding member shown in FIG. 3.
Figure 7:
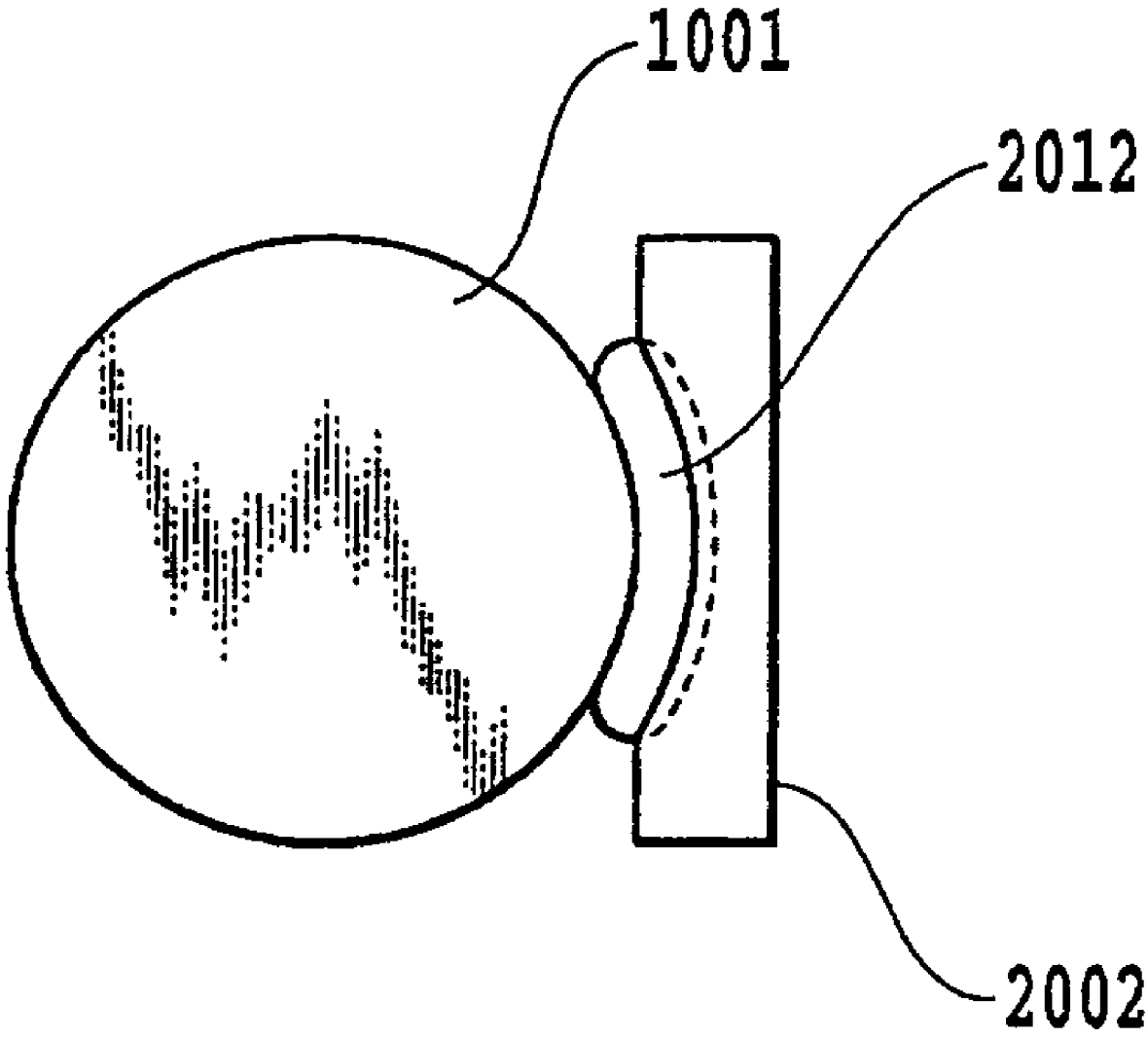
FIG. 7 is a left side view showing a state where a contact portion of the liquid holding member shown in FIG. 3 is brought into contact with the liquid coating roller.
Figure 8:
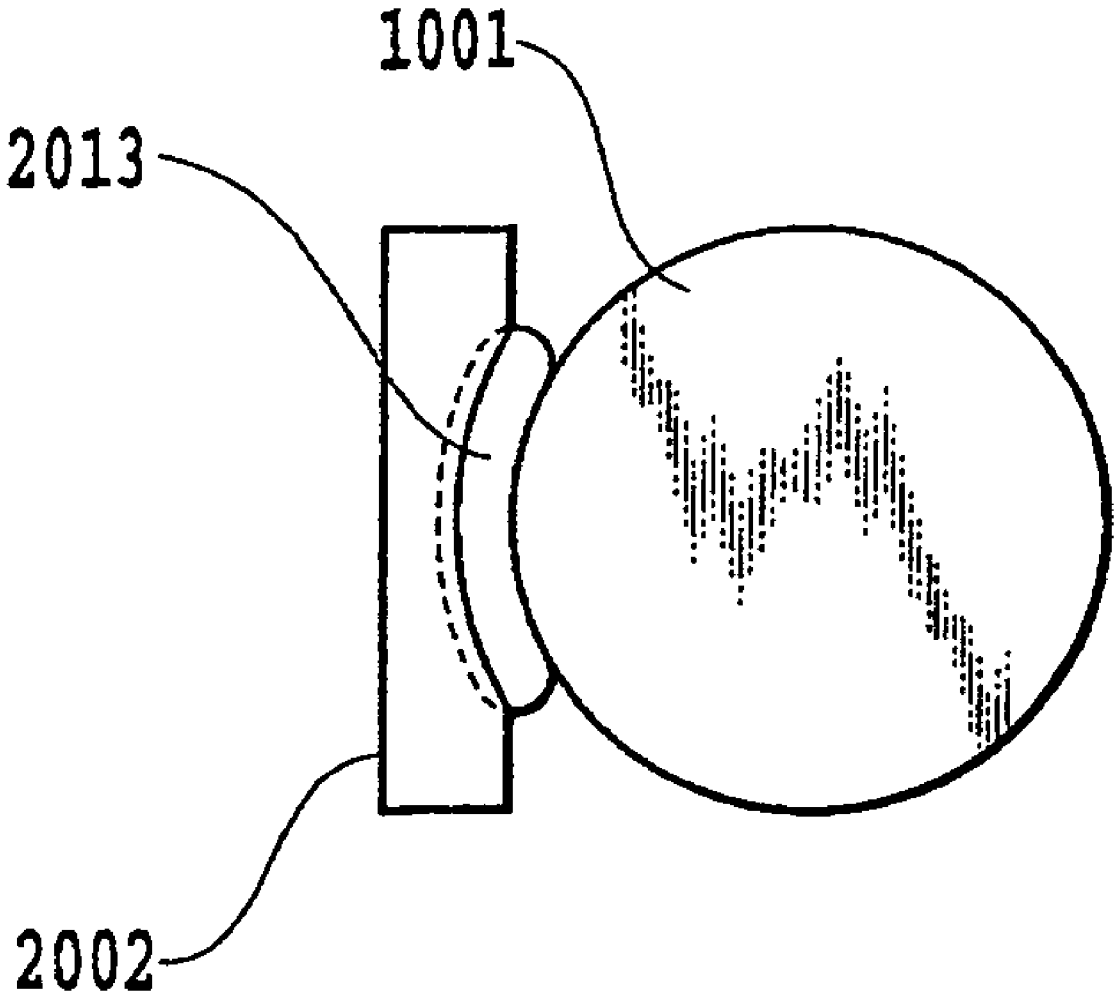
FIG. 8 is a right side view showing a state where a contact portion of the liquid holding member shown in FIG. 3 is brought into contact with the liquid coating roller.

Moreover, both right and left side portions 2012, 2013 in the longitudinal direction of the contact member 2009 form a slowly curved shape seen from any direction of front (FIG. 3), plane (FIG. 6) and sides (FIGS. 7, 8). Therefore, even if the contact member 2009 is brought into contact with the coating roller 1001 with a relatively large pressing force, the entire contact member 2009 is elastically deformed substantially uniformly, and a large local distortion is not generated. Therefore, the contact member 2009 is brought into contact with the outer circumferential surface of the coating roller 1001 continuously without a gap as shown in FIGS. 6 to 8, and the above substantially blocked space can be formed.

Figure 4:
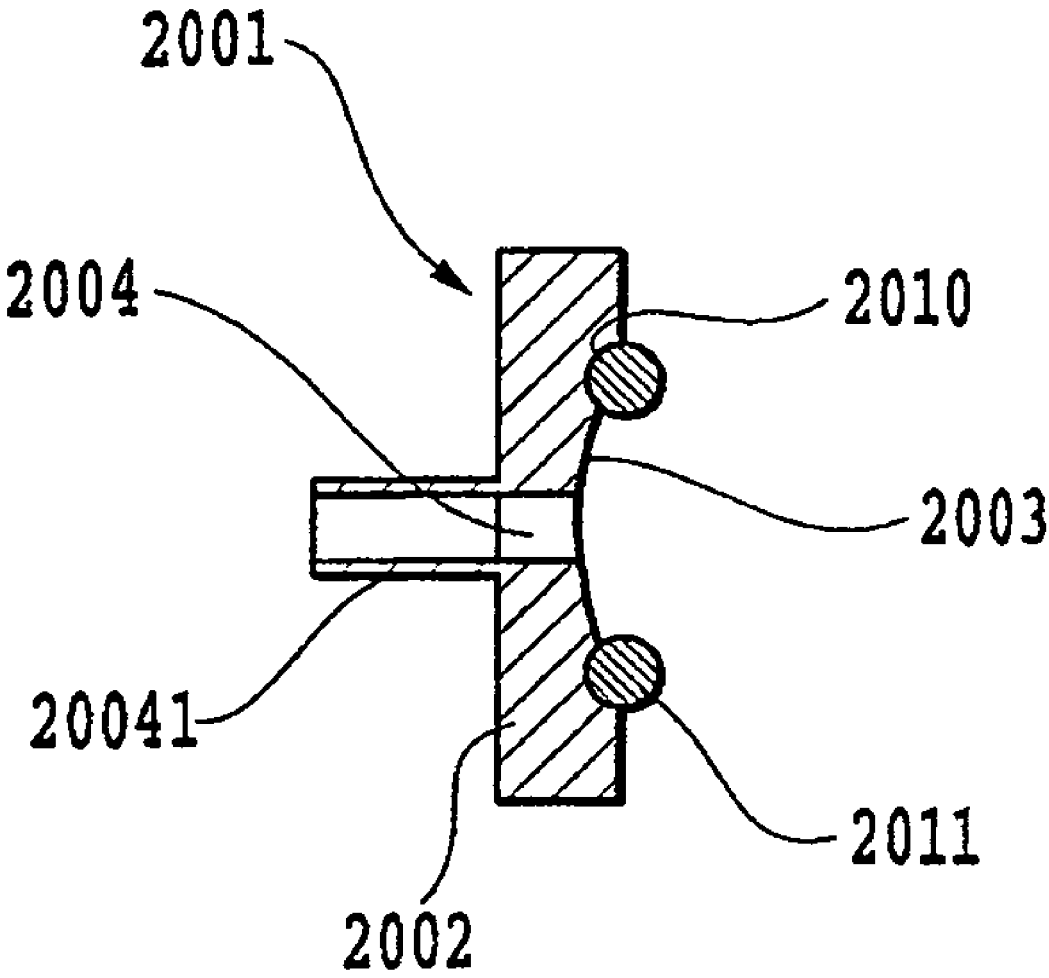
FIG. 4 is a section view showing an end face of the liquid holding member shown in FIG. 3 cut along IV-IV lien.
Figure 5:
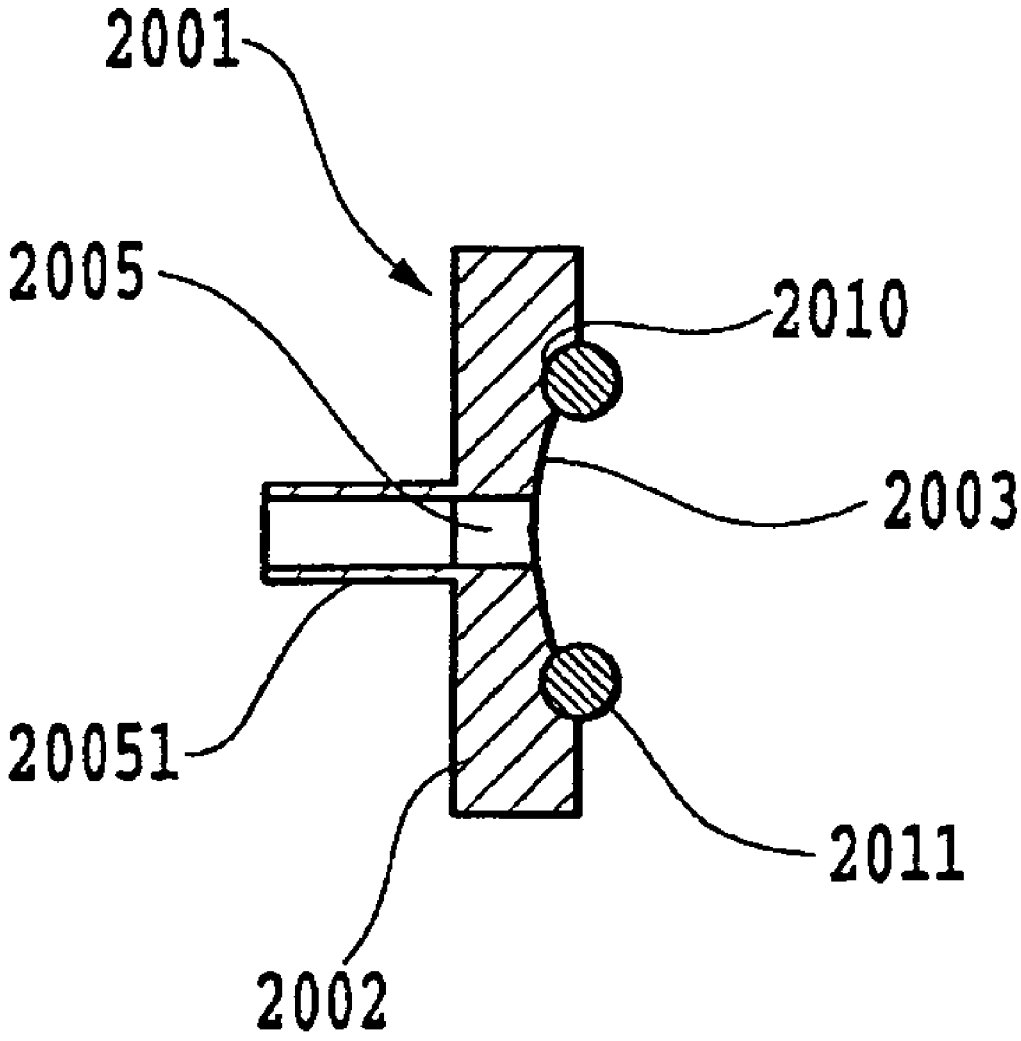
FIG. 5 is a section view showing an end face of the liquid holding member shown in FIG. 3 cut along V-V line.

A liquid supply port 2004 and a liquid return port 2005 having a hole piercing the space forming member 2002, respectively, are provided in an area surrounded by the contact member 2009 in the space forming member 2002 as shown in FIGS. 3 to 5. These ports communicate with cylindrical connection portions 20041, 20051 projected on the back surface side of the space forming member. These connection portions 20041, 20051 are connected to a liquid supply flow path 3000, which will be described later. In this embodiment, the liquid supply port 2004 is formed in the vicinity of one end portion (left end portion in FIG. 3) of the area surrounded by the contact member 2009, while the liquid return port 2005 is provided in the vicinity of the other end portion (right end portion in FIG. 3) of the same area. The liquid supply port 2004 supplies the coating liquid supplied from the liquid flow path 3000 to the above-mentioned liquid holding space S, while the liquid return port 2005 flows out the liquid in the liquid holding space S into the liquid flow path 3000. By this supply/flow-out of the liquid, the coating liquid flows from the above-mentioned left end portion to the right end portion in the liquid holding space S.

Coating Liquid Flow Path

Figure 11:
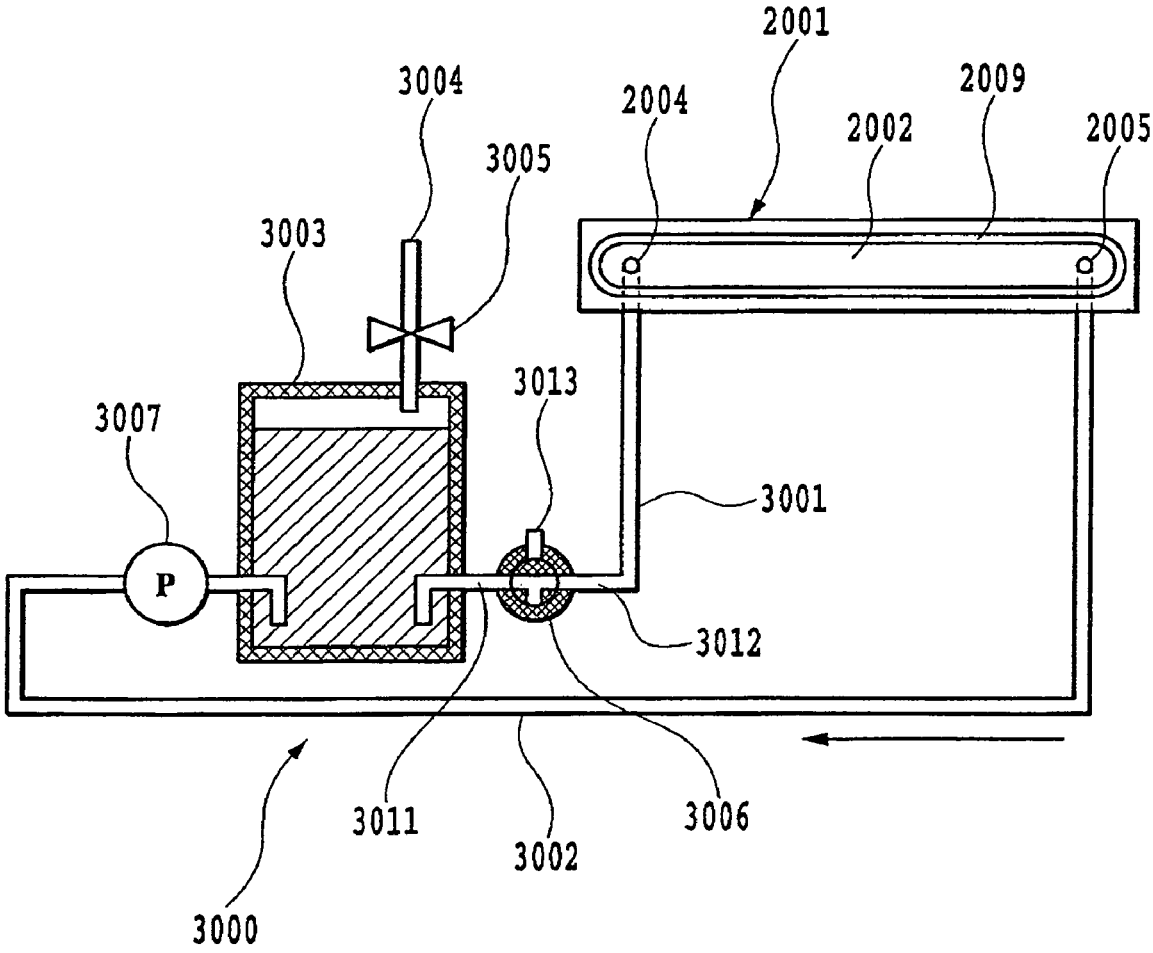
FIG. 11 is a view showing an outline configuration of liquid flow paths of a liquid applying apparatus in the embodiment of the present invention.

FIG. 11 is an explanatory view showing an outline configuration of the liquid flow path 3000 connected to the liquid holding member 2001 of the coating liquid supply mechanism.

The liquid flow path 3000 has a first flow path (supply flow path) 3001 connecting the liquid supply port 2004 of the space forming member 2002 composing the liquid holding member 2001 to a reservoir tank 3003 for storing the coating liquid. Also, the liquid flow path 3000 has a second flow path (return flow path) 3002 connecting the liquid recovery port 2005 of the space forming member 2002 to the reservoir tank 3003. The reservoir tank 3003 is provided with an atmospheric air communication port 3004, and the atmospheric air communication port is provided with an atmospheric air communication valve 3005 for switching communication/shut-off of the path to the atmospheric air. Also, a switching valve 3006 is provided in the first flow path 3001 so that the communication/shut-off of the first flow path 3001 with the atmospheric air can be switched. Moreover, in the second flow path 3002, a pump 3007 for forcibly fluidizing the coating liquid and air in the liquid flow path 3000 in a desired direction is connected.

In this embodiment, the first flow path 3001 and the second flow path 3002 are formed from circular tubes. Opening portions formed at the ends of the respective tubes are arranged at a bottom portion or a position close to the bottom portion of the reservoir tank 3003 so that the coating liquid in the reservoir tank 3003 can be completely consumed.

Also, the switching valve 3006 of this embodiment may be any type if it is capable of switching communication and shut-off between the first flow path 3001 and the atmospheric air, and a three-way valve as shown in FIG. 11 is used here. The three-way valve 3006 has three ports communicating with each other. Two ports of them can be selectively made communicate with any two of a tube 3011 on the reservoir tank side, a tube 3012 on the liquid holding member side and an atmospheric air communication port 3013 in the first flow path 3001. Further, by switching with the three-way valve 2006, a connected state for connecting the tube 3011 to the tube 3012 and a connected state for connecting the tube 3012 to the atmospheric air communication port 3013 can be selectively switched. By this, to the space S formed by the liquid holding member 2001 and the coating roller 1001, either of the coating liquid in the reservoir tank 3003 or the air taken in from the atmospheric air communication port 3013 can be selected and supplied. It is to be noted that the switching of the three-way valve 3006 is performed by a control signal from a control portion 4000, which will be described later, and filling, supply of the coating liquid are carried out.

Control System

Figure 12:
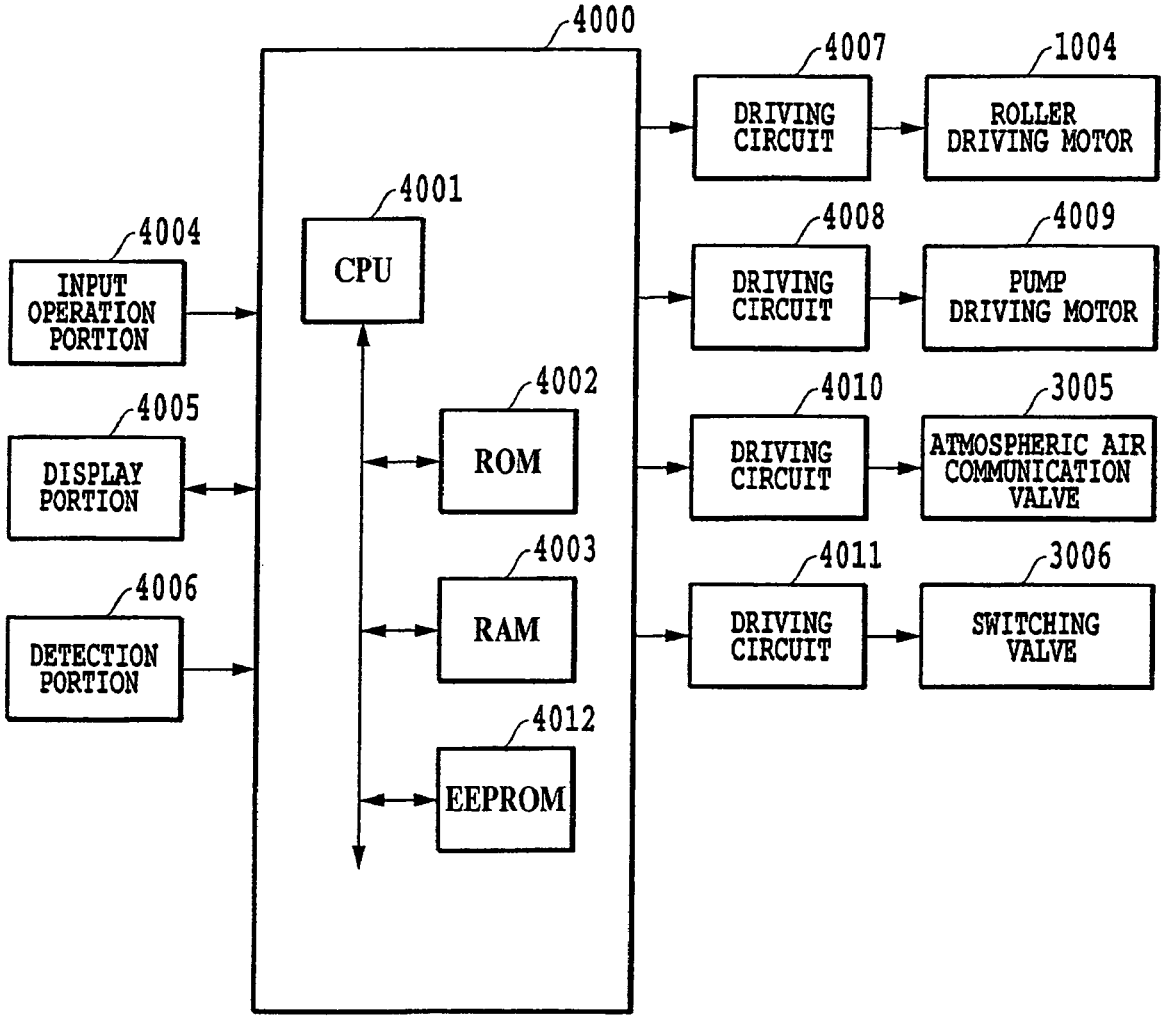
FIG. 12 is a block diagram showing an outline configuration of a control system in the embodiment of the present invention.

FIG. 12 is a block diagram showing an outline configuration of a control system in the liquid applying apparatus of this embodiment.

In this figure, 4000 denotes a control portion for controlling the entire liquid applying apparatus. The control portion 4000 has a CPU 4001 for executing processing operation such as various calculations, control and discrimination. Also, a ROM 4002 for storing control programs such as processing, which will be described later in FIGS. 13 to 15, executed by this CPU 4001 and a RAM 4003 for temporarily storing data during processing operation of the CPU 4001 and input data are provided. Moreover, an EEPROM 4012 for holding the contents of a flag when power is OFF is provided. An information flag (end process flag) indicating whether an end process has been completed or not, which will be described later, is stored in the EEPROM 4012 as a storage medium.

To this control portion 4000, an input operation portion 4004 including a keyboard for inputting a predetermined command or data or various switches, a display portion 4005 for making various displays including input/setting state of the liquid applying apparatus, a detection portion 4006 including a sensor for detecting a position of the coating medium and an operation state of each portion, the above roller driving motor 1004, a pump driving motor 4009, the atmospheric air communication valve 3005 and the switching valve 3006 are respectively connected via driving circuits 4007, 4008, 4010, 4011.

Liquid Applying Operation Sequence

Figure 13:
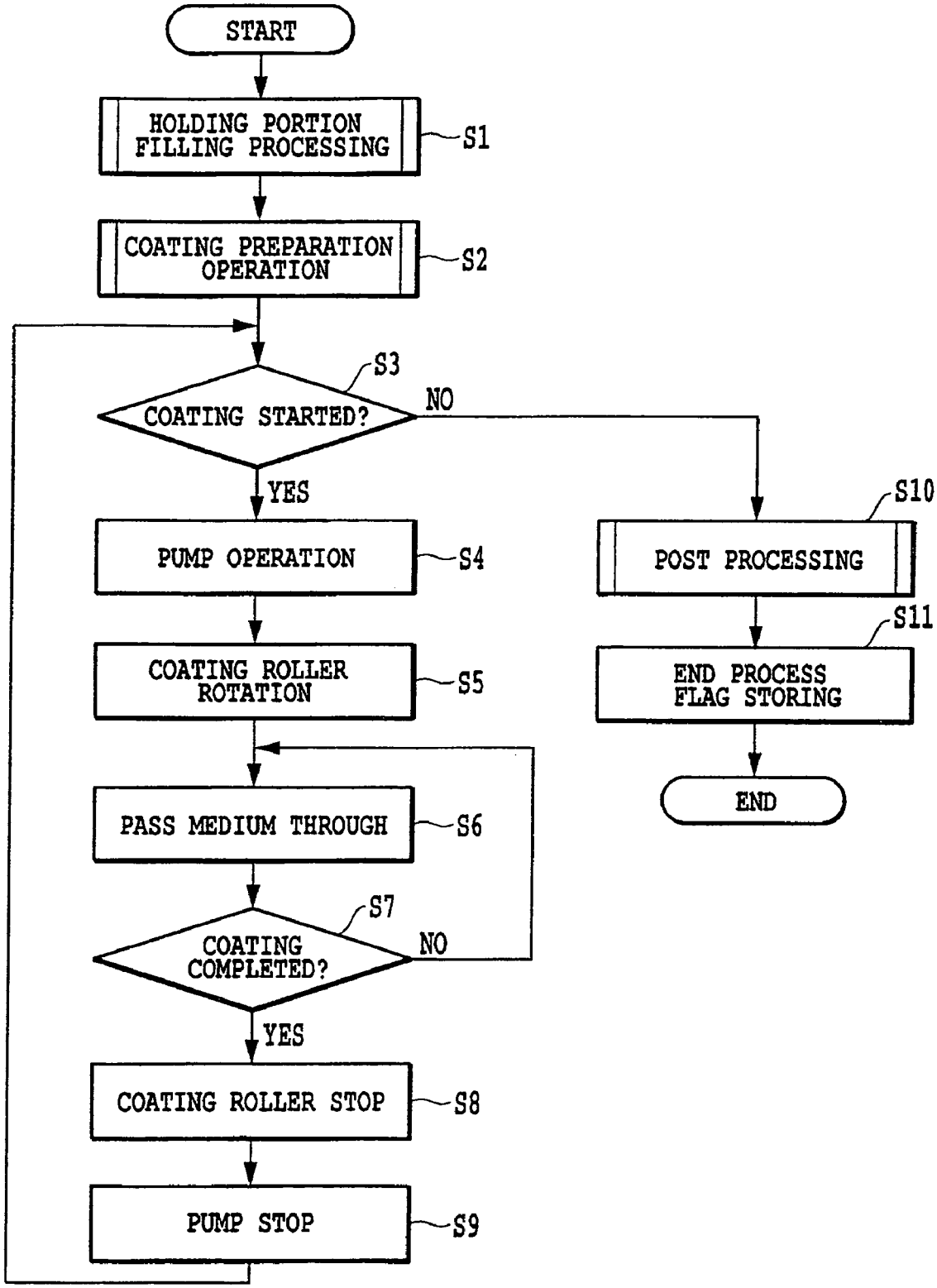
FIG. 13 is a flowchart showing a process of liquid applying in the liquid applying apparatus according to the preferred embodiment.

FIG. 13 is a flowchart showing processes relating to liquid applying in the liquid applying apparatus of this embodiment. Each process relating to liquid applying will be described below referring to the flowchart. That is, when power is supplied to the liquid applying apparatus, the control portion 4000 executes the following coating operation sequence according to the flowchart shown in FIG. 13.

[Filling Process]

At Step S1, a filling process of the coating liquid to the holding space (holding portion) S is executed.

Figure 14:
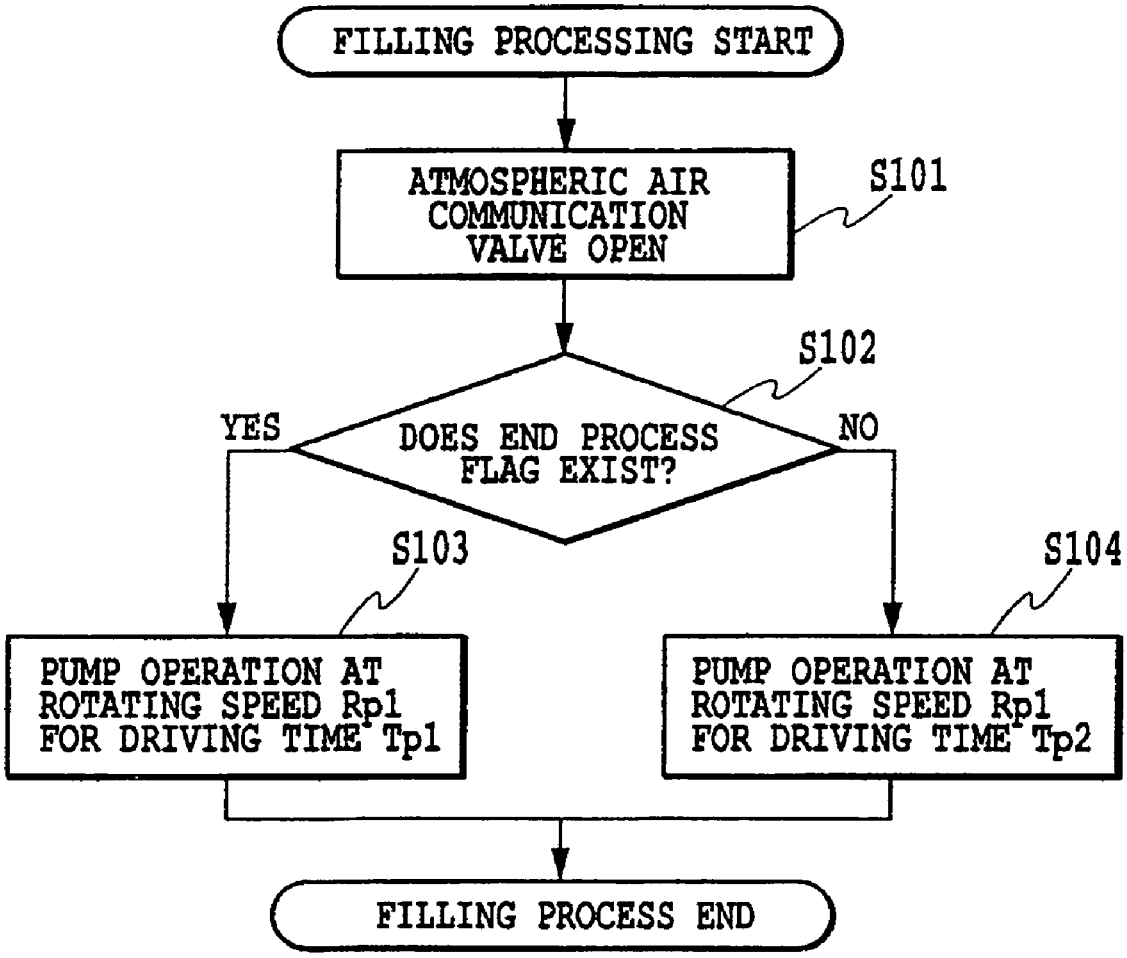
FIG. 14 is a flowchart showing details of a filling process according to a first embodiment of the present invention.

FIG. 14 is a flowchart showing detailed processes of the filling process. In FIG. 14, first, the atmospheric air communication valve 3005 is opened so as to open the reservoir tank 3003 into the atmospheric air (Step S101).

Next, it is determined whether an end process flag is set or not by referring to an end process flag (Step S102). That is, the end process flag is set, as will be described later at Steps S10, S11 in FIG. 13, when the end process including an operation to recover the coating liquid from the liquid holding space S and the liquid flow paths 3001, 3002 shown in FIG. 11 and to return it to the reservoir tank 3003 has been executed. Thus, when the end process flag is stored (set), it is determined that the recovering operation of the coating liquid has been normally executed at the previous power-off of. On the other hand, if the end process flag is not set, it is determined that the power was turned off without executing the recovering operation. As an example that the power is turned off without executing the recovering operation, there may be a case where the operation of the apparatus is unintentionally stopped due to outage or the like.

And then, the filling operation is executed. In this case, if the recovering operation has been carried out, a normal mode of filling operation is executed. That is, in the liquid flow path shown in FIG. 11, the pump 3007 is operated for a specified time Tp1 at a rotation speed Rp1 (Step S103). By this, an air inside the liquid holding space S and the respective flow paths 3001, 3002 is fed to the reservoir portion by the pump to be discharged to the outside in the atmospheric air, and then the coating liquid is filled in respective portions of the liquid holding space S and the respective flow paths 3001, 3002.

On the other hand, if it is determined that the end process flag is not stored, there is a possibility that the recovering operation has not been executed normally and the increased viscosity or fixed coating liquid exists in the liquid holding member or the liquid flow path. Therefore, at Step S104, a filling mode which generates a stronger fluidization than the normal filling operation executed at Step S103 is carried out as a filling operation also acting as a restoration operation. More specifically, the pump 3007 is operated for a specified time Tp2, which is longer than the above specified time Tp1, at a rotation speed Rp1. Here, the specified time Tp2 is a time enough to re-fluidize the increased viscosity or fixed liquid remaining in the liquid holding space S and the respective liquid flow paths 3001, 3002. By this, the increased viscosity coating liquid existing in the liquid holding space and the respective liquid flow paths is re-fluidized to an extent that will not interfere with circulation, and normal filling of the coating liquid is executed. By this filling operation also acting as the restoration operation, the coating liquid is brought into a state that can be supplied to the coating roller 1001.

In the filling also acting as restoration, instead of extending the time for filling than the normal filling operation, a rotating speed of the pump may be increased, as will be described in a later preferred embodiment, or it is a matter of fact that both the time and rotating speed may be increased.

Also, as mentioned above, if the recovering operation was normally executed at the previous power off, liquid fluidization as the filling operation is carried out at Step S103. On the other hand, it is filling operation also acting as the restoration operation that is executed at Step S104. In this way, it may be possible that the predetermined restoration operation is first executed at Step S104 and then, the same filling operation as in Step S103 is carried out. In this case, if the specified times for driving the pump are to be made different as above, the excess of the specified time may be considered as the restoration operation.

Referring to FIG. 13, again, when the above-mentioned filling operation shown FIG. 14 is finished (Step S1), coating preparation operation is carried out (Step S2).

Figure 15:
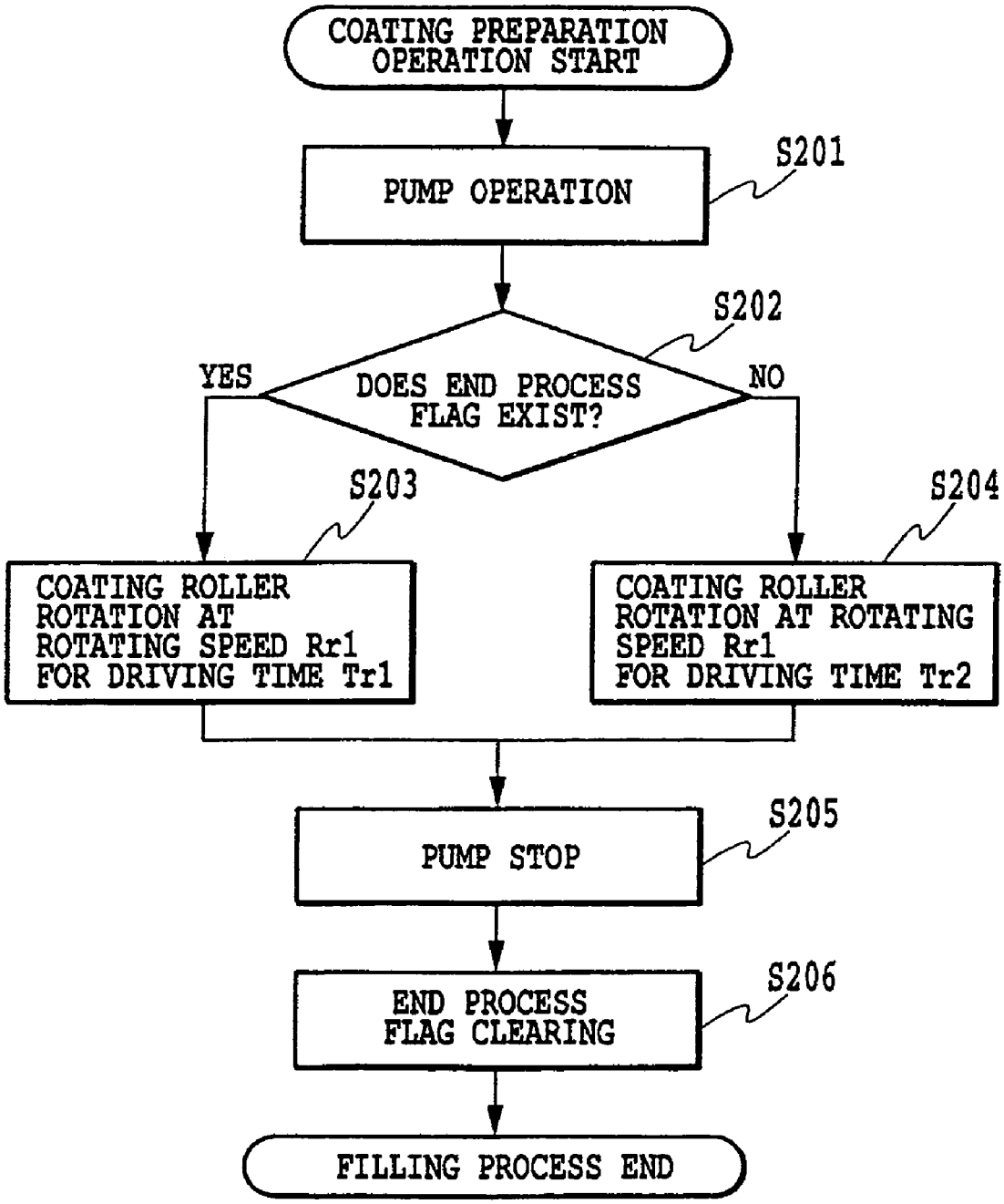
FIG. 15 is a flowchart showing details of a coating preparation operation process according to the first embodiment.

FIG. 15 is a flowchart showing details of this coating preparation operation process. In FIG. 15, first, the pump 3007 in the flow path shown in FIG. 11 is operated (Step S201). Next, the end process flag is referred to as in the processing of Step S1 (Step S202).

Here, if the end process flag is stored, it is determined that the coating liquid is normally recovered at the previous power off. That is, an amount of the coating liquid adhering to the surface of the coating roller in the liquid holding space S is determined as a small quantity. In this case, the coating roller 1001 is rotated for a specified time Tr1 at a rotating speed Rr1 (Step S203).

On the other hand, if the end process flag is not stored, it is determined that the end process is not normally executed. In this case, there is a possibility that the coating liquid remains adhering to the surface of the coating roller forming the liquid holding space S and the coating liquid might be thickened.

Then, the coating roller 1001 is rotated for a specified time Tr2 longer than the above specified time Tr1 at the rotating speed Rr1 (Step S204). Here, the specified time Tr2 is enough time so that the increased viscosity coating liquid adhering to the surface of the coating roller 1001 can be scraped by the contact member 2009 or re-fluidized by a normal coating liquid. By this, the surface of the coating roller is brought back to a normal state. In this way, the rotation of the coating roller corresponds to the restoration operation of the coating roller.

It is possible to remove the increased viscosity coating liquid adhering to the coating roller by rotating the coating roller at the filling operation in the filling process at Step S1. However, in this embodiment, in order to ensure this removal, the preparation operation including the restoration operation is carried out as mentioned above. When the rotation of the roller is completed, the pump is stopped (Step S205), and the end process flag is cleared in the case that it is stored in the EEPROM (Step S206).

[Coating Operation]

Referring to FIG. 13, again, the coating operation is started upon a coating start command (Step S3). When the coating operation is started, first, the pump is operated (Step S4). Also, the coating roller 1001 starts to rotate clockwise as shown in an arrow in FIG. 1 (Step S5). By this rotation of the coating roller 1001, the coating liquid L filled in the liquid holding space S slides out between the coating roller 1001 and a lower edge 2011 of the contact member 2009 against a pressing force of the contact member 2009 of the liquid holding member 2001 onto the coating roller 1001. Then the liquid adheres to the outer circumference of the coating roller 1001 in a layered state. The coating liquid L adhering to the coating roller 1001 is fed to the contact portion between the coating roller 1001 and the counter roller 1002.

Figure 9:
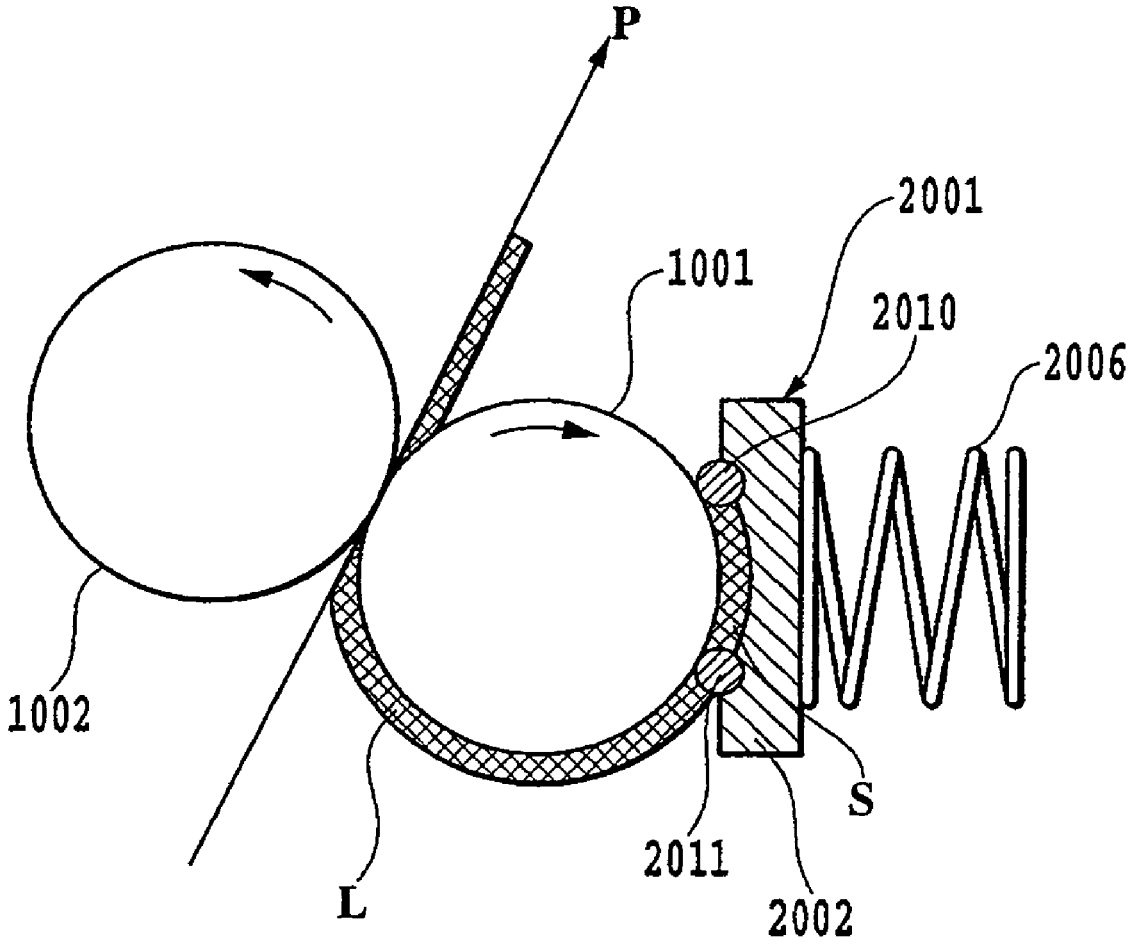
FIG. 9 is a sectional view showing a state where a coating liquid is filled in a liquid holding space formed by the liquid holding member and the coating roller and the liquid is applied to a coating medium by rotation of the coating roller in a embodiment of the present invention.

Then, by the coating medium feed supply mechanism 1006, a coating medium is conveyed to a portion between the coating roller 1001 and the counter roller 1002, between which the coating medium is inserted. Also, in response to the rotation of the coating roller 1001 and the counter roller 1002, the medium is conveyed toward the paper discharge portion (Step S6). During this conveyance, the coating liquid applied to the outer circumferential surface of the coating roller 1001 is transferred to the coating medium P as shown in FIG. 9. It is needless to say that a mechanism for supplying the coating medium to a portion between the coating roller 1001 and the counter roller 1002 is not limited to the above feed/supply mechanism. For example, a mechanism by manual insertion using a predetermined guide member as supplementary means may be used together, a configuration using the manual insertion mechanism alone or any other mechanism may be used.

In FIG. 9, a portion expressed by crossing diagonal lines indicates the coating liquid L. Here, the thickness of the coating liquid layer in the coating roller 1001 and the coating medium P is expressed in a much more exaggerated manner than an actual thickness for clear representation of the state of the coating liquid L at coating.

As mentioned above, the coated portion of the coating medium P is conveyed in the arrow direction by a conveying force of the coating roller 1001. With this, an uncoated portion of the coating medium P is conveyed to the contact portion between the coating medium P and the coating roller 1001. These operations are performed continuously or intermittently so that the coating liquid is applied to the entire coating medium.

FIG. 9 shows an ideal coating state where all the coating liquid L having passed through the contact member 2009 and adhering to the coating roller 1001 is transferred to the coating medium P. However, in actuality, not all of the coating liquid L adhering to the coating roller 1001 is transferred to the coating medium P. That is, while the coating medium P to be conveyed is separated from the coating roller 1001, the coating liquid L also adheres to the coating roller 1001, and the coating liquid L remains on the coating roller 1001 in many cases. The remaining amount of the coating liquid L in the coating roller 1001 is varied depending on a material and a slight irregularity on the surface of the coating medium P. When the coating medium P is a plain paper, the coating liquid L remains on the circumferential surface of the coating roller 1001 even after the coating operation.

Figure 20:
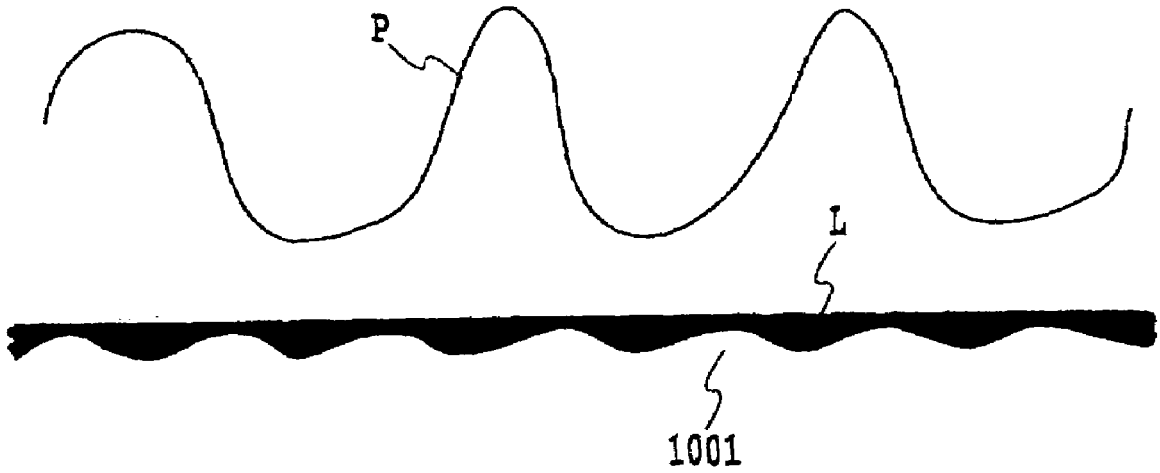
FIG. 20 is an explanatory view for explaining a coating process on a coating surface of the coating roller and a surface of a medium, when the medium is a plain paper, and showing a state on the upstream side of a nip portion between a coating roller 1001 and a counter roller 1002 in the embodiment of the present invention.
Figure 21:
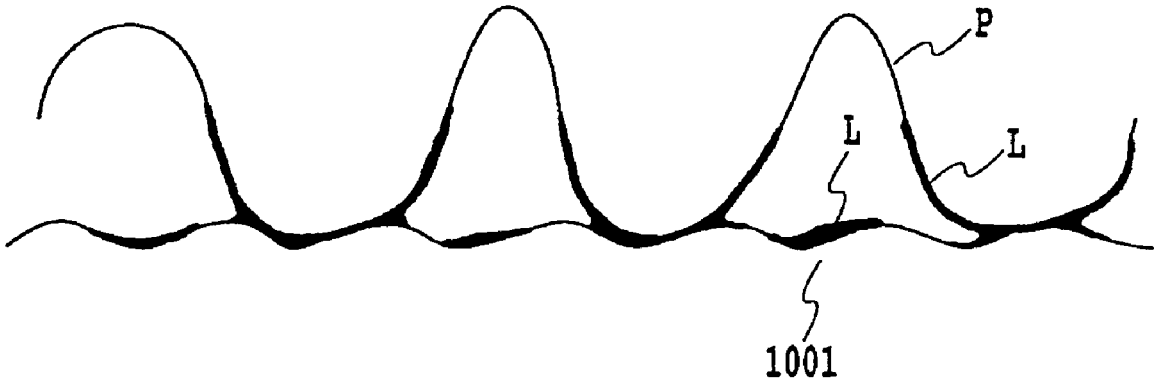
FIG. 21 is an explanatory view for explaining the coating process on a coating surface of the coating roller and a surface of a medium, when the medium is a plain paper, and showing a state of the surface of the plain paper, which is a medium P, and the coating surface of the coating roller 1001 at the nip portion between the coating roller 1001 and the counter roller 1002 in the embodiment of the present invention.
Figure 22:
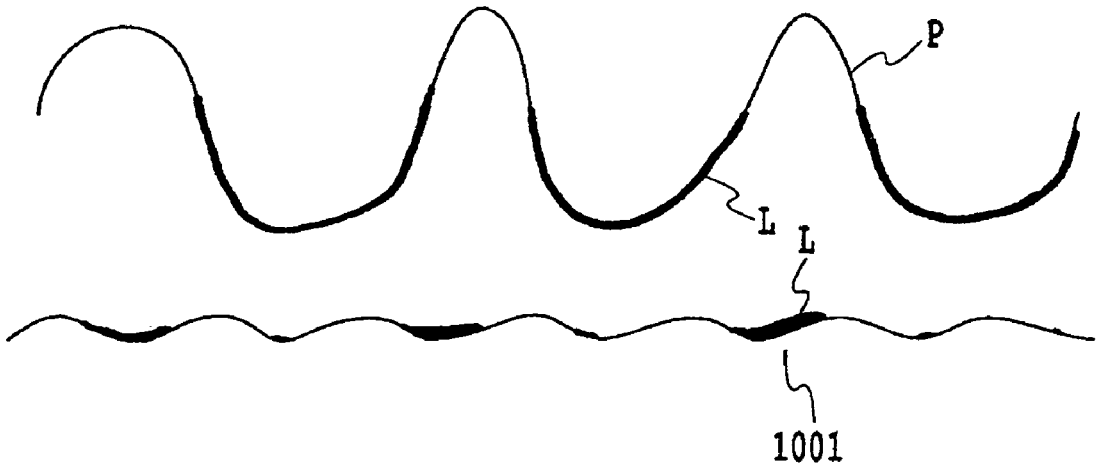
FIG. 22 is an explanatory view for explaining a coating process on a coating surface of the coating roller and a surface of a medium, when the medium is a plain paper, and showing a state on the downstream side from a nip portion between the coating roller 1001 and the counter roller 1002 in the embodiment of the present invention.

FIGS. 20, 21, 22 show explanatory views for explaining the coating process on the surface of the coating roller and the surface of the medium when the medium P is a plain paper. In these figures, the liquid is denoted by black color.

FIG. 20 shows a state of the upstream side of the nip portion between the coating roller 1001 and the counter roller 1002. In this figure, the liquid adheres to the coating surface of the coating roller 1001 so that a subtle irregularity on the surface of the coating surface is slightly covered by the liquid.

FIG. 21 shows a state of the surface of the plain paper, which is the medium P, and the coating surface of the coating roller 1001 at the nip portion of the coating roller 1001 and the counter roller 1002. In this figure, convex portions on the surface of the plain paper, which is the medium P, are in contact with the coating surface of the coating roller 1001, and the liquid instantaneously penetrates or adsorbs into fibers on the surface of the plain paper, which is the medium P from the portion in contact. Also, on the coating surface of the coating roller 1001, the liquid adhering to a portion not in contact with the convex portions on the surface of the plain paper remains.

FIG. 22 shows a state on the downstream side of the nip portion of the coating roller 1001 and the counter roller 1002. In this figure, the coating surface of the coating roller 1001 is completely removed from the medium. On the coating surface of the coating roller 1001, the liquid remaining on the portion not in contact with the convex portions on the surface of the plain paper and the liquid at the contact portion, though in an extremely small amount, remain on the coating surface.

The coating liquid remaining on the coating roller 1001 passes between the coating roller 1001 and the upper edge portion 2010 of the contact member 2009 against the pressing force of the contact member 2009 of the liquid holding member 2001 applied to the coating roller 1001 and returns into the liquid holding space S. Then it is mixed with the coating liquid filled in the space S.

Figure 10:
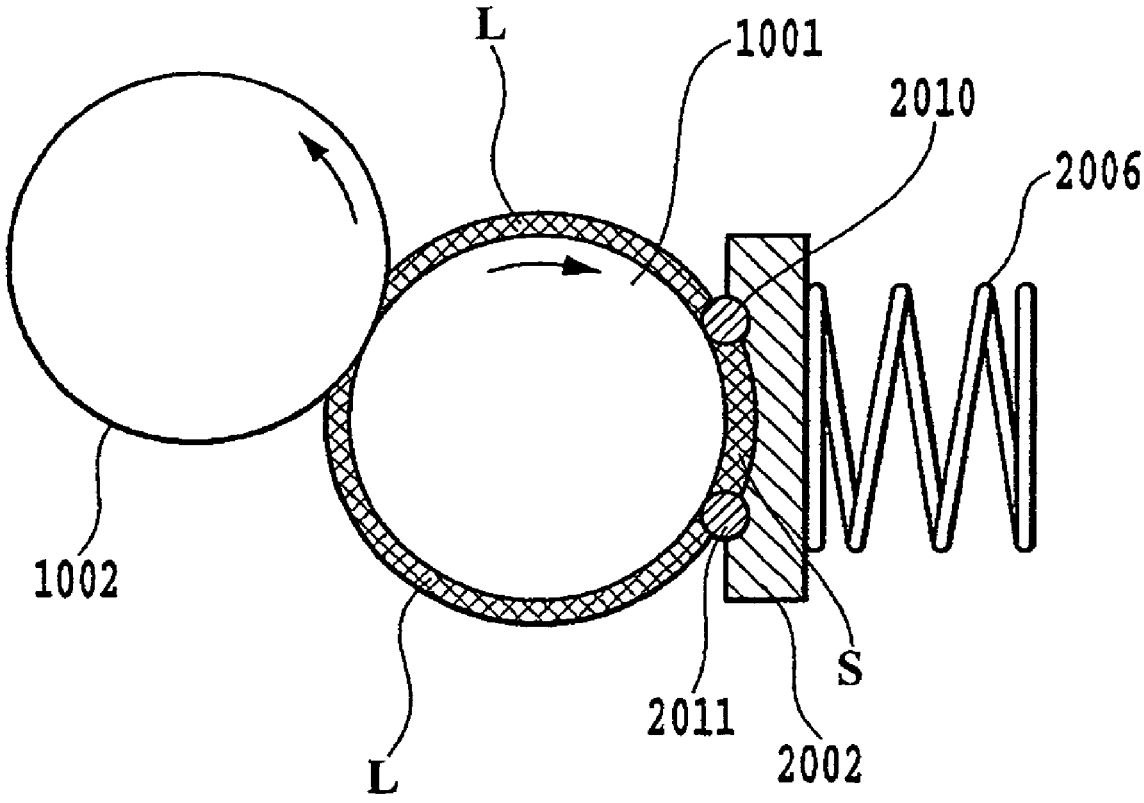
FIG. 10 is a sectional view showing a state where a coating liquid is filled in a liquid holding space formed by the liquid holding member and the coating roller and the coating roller is rotated while the coating medium does not exist in the embodiment of the present invention.

Also, this returning operation of the coating liquid is also carried out when the coating roller 1001 is rotated in the state where the coating medium does not exist as shown in FIG. 10. More specifically, by rotating the coating roller 1001, the coating liquid adhering to the outer circumference of the coating roller 1001 passes through the portion (nip portion) in contact with the counter roller 1002. After passing through, the coating liquid is divided into the coating roller 1001 side and the counter roller 1002 side, and the coating liquid remains on the coating roller 1001. Then the coating liquid L adhering to the coating roller 1001 side passes between the upper edge portion 2010 of the contact member 2009 and the coating roller 1001 and enters into the liquid holding space S, where it is mixed with the coating liquid filled therein.

[End Process]

When the coating operation to the coating medium has been executed as mentioned above, determination is made if the coating process may be finished or not (Step S7). If the coating process is not to be finished, the process returns to step S6, where the coating operation is repeated until the coating process is finished for all the portions requiring coating of the coating medium. When the coating process is finished, the coating roller 1001 is stopped (Step S8), and moreover, driving of the pump 3007 is stopped (Step S9). After that, the process goes on to step S2, and if the coating start command has been inputted, the operations in the above Steps S2 to S9 are repeated. If the coating start command has not been inputted, post processing such as the recovering operation to recover the coating liquid from the holding space S and the liquid flow paths is carried out (Step 10), and the process relating to the coating is completed. After the post processing in Step 10, the end process flag is stored in the EEPROM 4012 (Step 11).

The above recovering operation (Step 10) is executed by opening the above atmospheric air communication valve 3005 and the switching valve 3006 and driving the pump 3007 so that the coating liquid in the coating liquid holding space S and the second flow path 3002 is made flow into the liquid reservoir tank 3003. By performing the recovering operation, evaporation of the coating liquid from the liquid holding space S can be suppressed. After the recovering operation, by closing the atmospheric air communication valve 3005, and switching the switching valve 3006 to shut off the communication with the first flow path 3001 and the atmospheric communication port 3013, the reservoir tank 3003 is shut off from the atmospheric air. By this, evaporations of the coating liquid from the liquid reservoir tank 3003 can be suppressed, and outflow of the coating liquid to the outside can be completely prevented even if the attitude of the apparatus is inclined due to movement or transportation.

As mentioned above, in this embodiment, even if the coating liquid remains held in the liquid holding space S or in the liquid flow paths due to abnormal end state or the like, determination is made before start of the coating on whether the coating liquid has been recovered or not. Then based on the determination result, the restoration operation to solve viscosity increasing or fixation of the coating liquid is executed. By this, the coating operation after that can be performed well.

Second Embodiment

Figure 16:
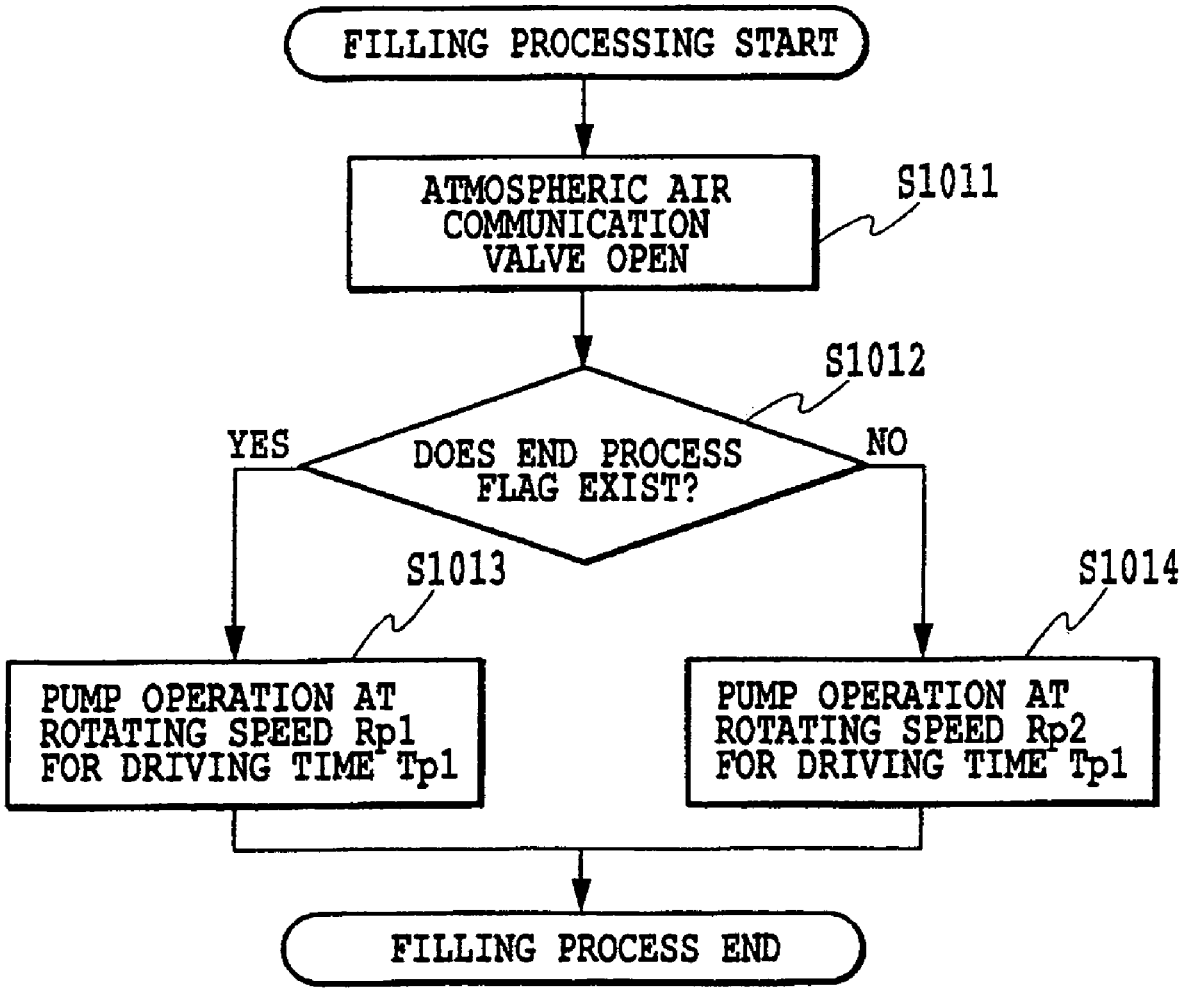
FIG. 16 is a flowchart showing details of a filling process according to a second embodiment of the present invention.
Figure 17:
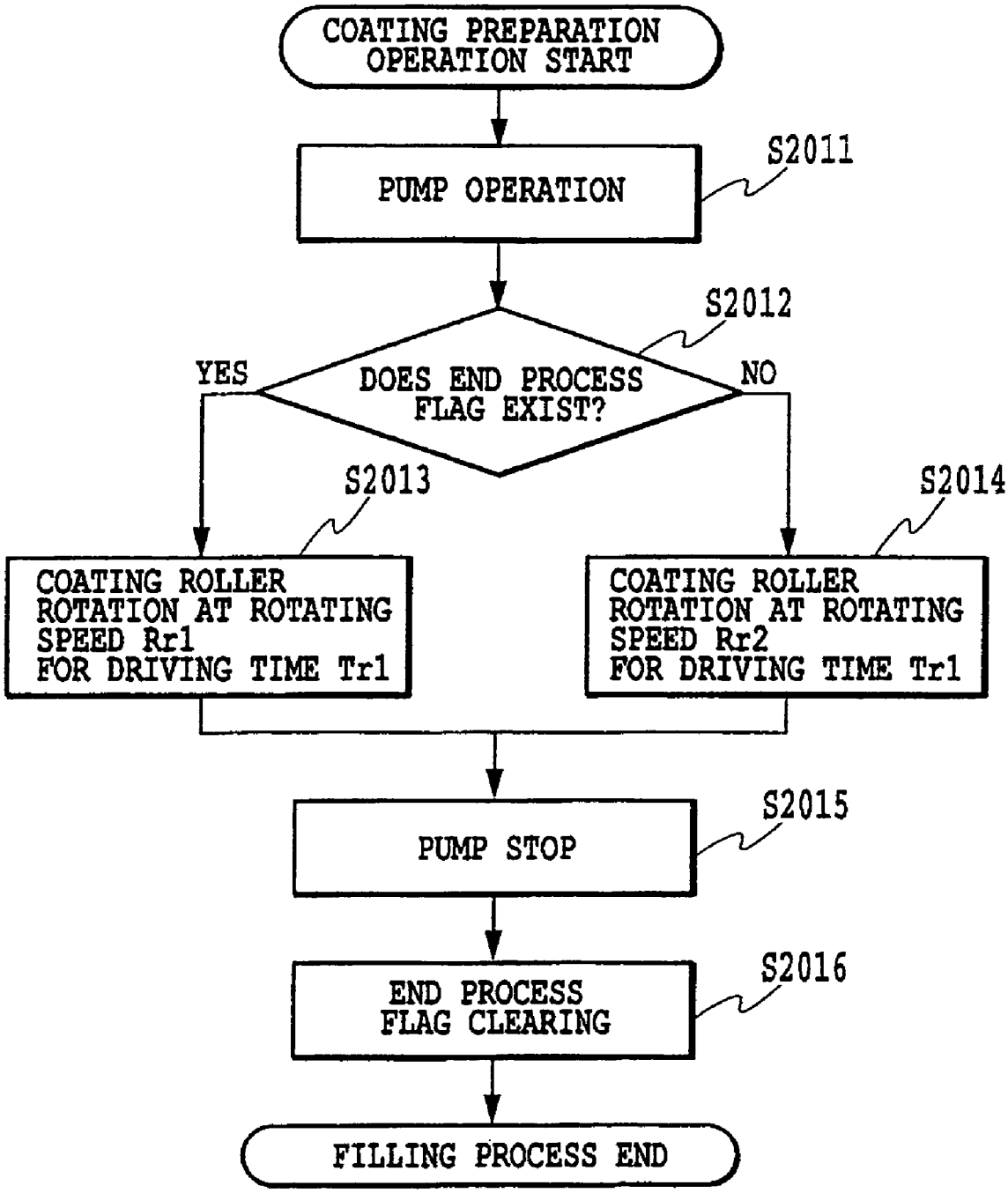
FIG. 17 is a flowchart showing details of a coating preparation operation process according to the second embodiment.

A second embodiment of the present invention is relates to modes in which the pump operating speed is increased in the filling process when it is determined that the end process has not been performed and the driving speed of the coating roller is increased in the coating preparation operation of the coating roller. FIGS. 16 and 17 are flowcharts respectively showing details of the filling operation and the coating preparation operation. The other operations are the same as in the above described first embodiment.

[Filling Process]

In FIG. 16, first, the atmospheric air communication valve 3005 is opened and the reservoir tank 3003 is opened to the atmospheric air (Step S1011). Next, it is determined whether the flag is stored (set) or not by referring to the end process flag (Step S1012). If the end process flag is stored, it is determined that the recovering operation of the coating liquid has been carried out at the previous power off, and then the pump 3007 is operated for the specified time Tp1 at the rotating speed Rp1 (Step S1013). By this, air in the liquid holding space S and the respective flow paths 3001, 3002 is fed to the reservoir portion by the pump to be discharged to the outside in the atmospheric air, and then the coating liquid is filled in respective portions of the liquid holding space S and the respective flow paths 3001, 3002.

On the other hand, if the end process flag is not stored, there is a possibility that the end process has not been executed normally at the previous power off and the viscosity increased coating liquid exists in the liquid holding member or the liquid flow path. Therefore, the pump 3007 is operated at a rotation speed Rp2, which is higher than the rotating speed Rp1 of the normal completion, for a specified time Tp1 (Step S1014). Here, the rotating speed Rp2 is a rotating speed enough to re-fluidize the viscosity increased liquid remaining in the liquid holding space S and the respective liquid flow paths 3001, 3002. By this, the viscosity increased coating liquid existing in the liquid holding space S and the respective liquid flow paths is re-fluidized to an extent that will not interfere with circulation, and normal filling of the coating liquid is executed well. By this initial operation, the coating liquid is brought into a state capable of supplying to the coating roller 1001.

[Coating Preparation Operation]

Next, in the coating preparation operation shown in FIG. 17, first, the pump is operated (Step S2011). Then, the end process flag is referred to and it is determined if the flag is stored or not (Step S2012). If the end process flag is stored, it is considered that the recovering operation of the coating liquid has been normally executed and an amount of the coating liquid adhering to the coating roller surface is slight, and thus the coating roller 1001 is rotated for the specified time Tr1 at the rotating speed Rr1 (Step 2013).

On the other hand, if the end process flag is not stored, it is determined that the power was turned off without executing the recovering operation normally. In this case, it is determined that the viscosity increased coating liquid adheres to the surface of the coating roller that forms the liquid holding space S, and then the coating roller 1001 is rotated at the rotating speed Rr2, which is higher than the rotating speed Rr1, for the specified time Tr1 (Step 2014). Here, the rotating speed Rr2 is a speed enough so that the viscosity increased coating liquid adhering to the surface of the coating roller 1001 can be scraped by the contact member 2009 or re-fluidized by a normal coating liquid. By this, the surface of the coating roller is brought back to a normal state.

The preparation operation to increase the rotating speed of the coating roller at Step S2014 shown in FIG. 17 does not have to be carried out if the viscosity increased coating liquid can be sufficiently removed from the coating roller by the filling operation shown in FIG. 16, as in the first embodiment.

When the rotation of the coating roller is finished, the pump is stopped (Step S2015) and next, the end process flag is cleared in the case that it is stored in the EEPROM (Step S2016).

As mentioned above, even if the next coating operation is started while the liquid remains held in the liquid holding space S or the liquid flow paths due to abnormal end state or the like, determination is also made before start of the coating in this embodiment on whether the coating liquid has been recovered or not, as in the first embodiment. And based on the determination result, the restoration operation to solve viscosity increasing or fixation of the coating liquid can be executed. As a result, the subsequent coating operation can be performed well.

Third Embodiment

A third embodiment of the present invention relates to modes in which the coating liquid with a possibility of increased viscosity due to non-recovering is re-fluidized by increasing the numbers of driving cycles of the pump and the coating roller, respectively, in the filling operation and the coating preparation operation of the coating roller if the recovering operation was not executed at the previous power off of the apparatus.

Figure 18:
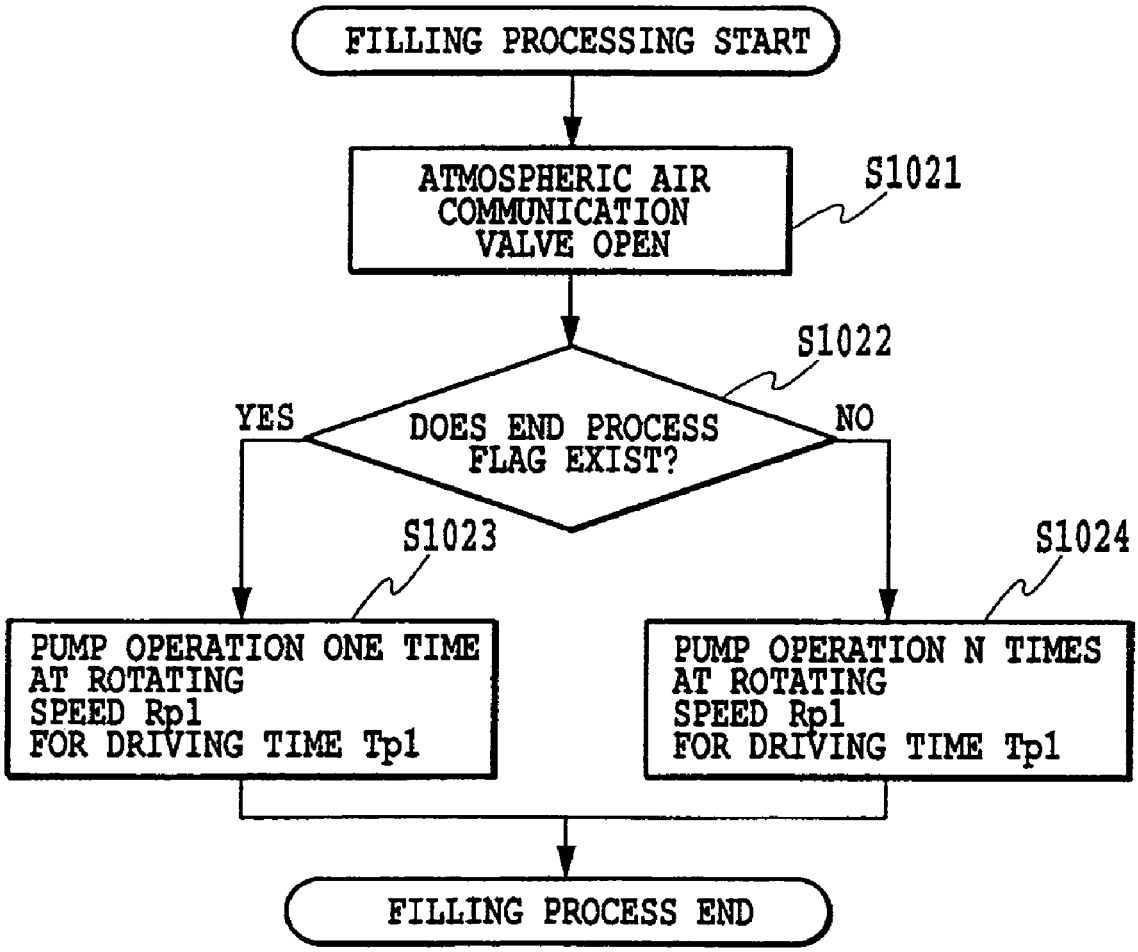
FIG. 18 is a flowchart showing details of a filling process according to a third embodiment of the present invention.
Figure 19:
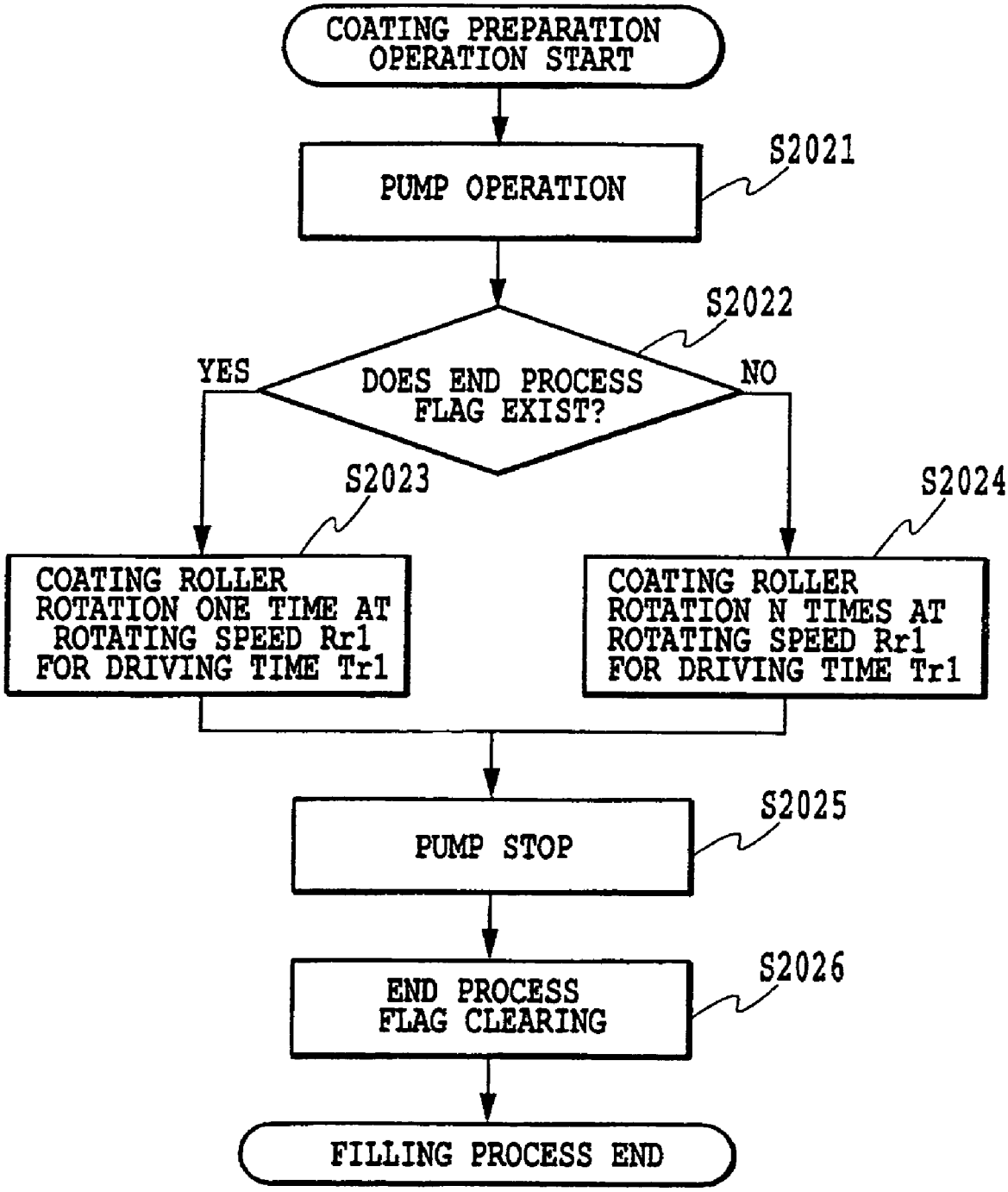
FIG. 19 is a flowchart showing details of a coating preparation operation process according to the third embodiment.

FIGS. 18 and 19 are flowcharts showing details of the filling operation and the coating preparation operation, respectively, according to this embodiment. The other operations are the same as those in the first embodiment.

[Filling Process]

In FIG. 18, first, the atmospheric air communication valve 3005 of the reservoir tank 3003 is switched to open the reservoir tank to the atmospheric air (Step S1021). Next, the end process flag is referred to (Step S1022) and if the end process flag is stored, it is determined that coating liquid was recovered normally, and an operation that the pump 3007 is operated at the rotating speed Rp1 for the specified time Tp1 is performed once as the normal filling operation (Step S1023).

On the other hand, if the end process flag is not stored, it is determined that the previous end process has not been finished normally and the viscosity increased coating liquid exists in the liquid holding member or the liquid flow paths, and the pumping operation that the pump 3007 is executed at the rotating speed Rp1 for the specified time Tp1 is carried out by N times (N>1), which is obtained by adding the number of times for restoration operation to the normal filling operation (Step S1024). Here, the number of operating times N is set to the number enough to re-fluidize the viscosity increased liquid remaining in the liquid holding space S and the liquid flow paths 3001, 3002. By this, the viscosity increased coating liquid existing in the liquid holding space S and the respective liquid flow paths is re-fluidized to an extent that will not interfere with circulation, and normal filling of the coating liquid is executed. By this initial operation, the coating liquid is brought into a state capable of supplying to the coating roller 1001.

[Coating Preparation Operation]

In the coating preparation operation shown in FIG. 19, first, the pump is operated (Step S2021). Next, the end process flag is referred to (Step S2022). If the end process flag is stored, it is determined that the recovering operation of the coating liquid was executed normally at the previous power off and an amount of the coating liquid adhering to the surface of the coating roller is slight. Then, the operation to rotate the coating roller 1001 at the rotating speed Rr1 for the specified time Tr1 of the normal preparation operation is executed once (Step 2023).

On the other hand, if the end process flag is not stored, it is determined that the recovering operation was not carried out normally. In this case, it is determined that the coating liquid adheres to the surface of the coating roller that forms the liquid holding space S, and the rotating operation of the coating roller 1001 at the rotating speed Rr1 for the specified time Tr1 is executed for M times (M>1), which is obtained by adding the number of restoration operation time to the normal preparation operation (Step 2014) Here, the number of operating times M is the number enough so that the viscosity increased coating liquid adhering to the surface of the coating roller 1001 can be scraped by the contact member 2009 or re-fluidized by a normal coating liquid. By this, the surface of the coating roller is brought back to a normal state.

When the roller rotation is finished, the pump is stopped (Step S2025) and the end process flag is cleared if it is stored in the EEPROM (Step S2026).

The preparation operation to increase the number of rotating operation times of the coating roller at Step S2024 shown in FIG. 19 does not have to be carried out if the viscosity increased coating liquid can be sufficiently removed from the coating roller by the filling operation shown in FIG. 18, as in the first and the second embodiments.

As mentioned above, even if the liquid remains held in the liquid holding space S and the flow paths due to abnormal end state or the like, determination on whether the coating liquid has been recovered or not is also made before start of the coating, and the restoration operation to re-fluidize the viscosity increased coating liquid can be carried out, also in this embodiment.

Fourth Embodiment

In the above-mentioned first to third embodiments, the applying apparatus for applying the coating liquid to paper has been described, but a fourth embodiment of the present invention relates to an ink-jet printing apparatus provided with the above-described applying apparatus as a coating mechanism. The printing apparatus of this embodiment has a coating mechanism, which is roughly the same as the above-mentioned applying apparatus. And the same operations as the filling operation (Step S1) and the rotation preparation operation (Step S2) shown in FIG. 13 are carried out. A difference from the above-mentioned applying apparatus will be mainly described below.

Figure 23:
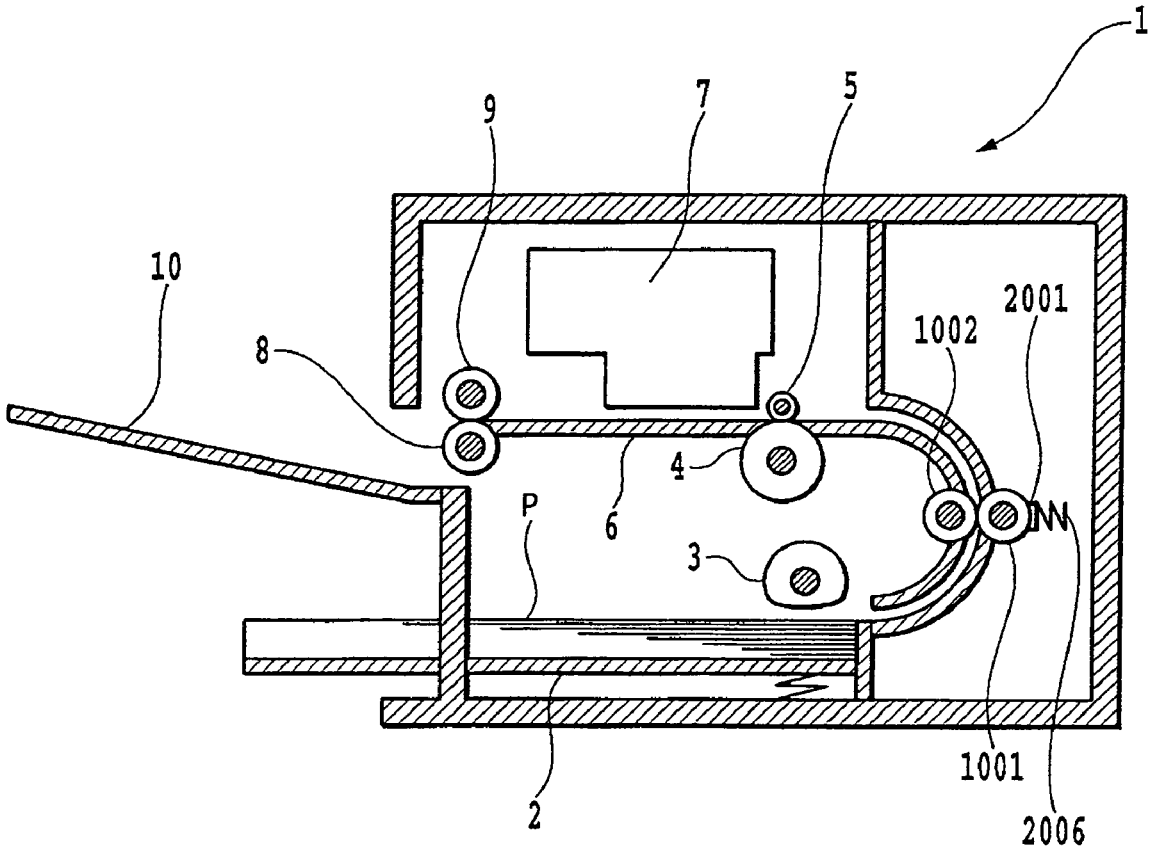
FIG. 23 is a sectional view showing a configuration of an ink-jet printer according to a fifth embodiment of the present invention.

FIG. 23 is a view showing an outline configuration of an ink-jet printer, which is an embodiment of the ink-jet printing apparatus according to the present invention. The ink-jet printer of this embodiment is provided with a liquid applying mechanism for applying a liquid to a printing medium such as a printing paper.

The ink-jet printer 1 is provided with a feed tray 2 on which a plurality of printing mediums P are loaded, and a separating roller 3 with a crescent-shaped section separates and feeds the printing medium P loaded on the feed tray 2 one by one to a conveying path. In the conveying path, a coating roller 1001 and a liquid holding member 2001 for supplying the coating liquid to the coating roller 1001 that composes the coating member in the liquid applying mechanism and a counter roller 1002 for holding the printing medium with the coating roller 1001 and conveying it are arranged. The coating roller 1001 is rotated in clockwise in FIG. 23 by rotation of the roller driving motor and applies the coating liquid to a required portion of the printing medium P while conveying the printing medium P upward in the figure. The surface of the coating roller 1001 is configured by a surface substantially without irregularity so that the coating liquid can be applied uniformly on the printing medium. The printing medium P on which the coating liquid has been applied is fed to a portion between the conveying roller 4 and a pinch roller 5, and by driving and rotation of the conveying roller 4 in the counterclockwise direction in the figure, the printing medium P is conveyed on a platen 6.

On the printing medium P conveyed on the platen 6, printing is performed at a position opposite to a printing head 7. More specifically, the printing head 7 is an ink-jet printing head provided with the predetermined number of nozzles for ink ejection. While the printing head 7 is scanned in the direction perpendicular to the surface of drawing, ink droplets are ejected from the nozzles to the printing medium P according to printing data to perform printing. By alternately repeating this printing operation and the conveying operation by a predetermined amount by the conveying roller 4, printing is performed on a portion of the printing medium to which the coating liquid has been applied. With this printing operation, the printing medium P is discharged onto a paper discharge tray 10 by a paper ejection roller 8 and a spur 9 provided on the downstream side of the scanning area of the printing head in the conveying path for the printing medium P.

As the ink-jet printing apparatus, a so-called full-line type ink-jet printing apparatus which performs printing operation using a lengthy printing head provided with a nozzle for ejecting ink over the maximum width of the printing medium can be configured.

The coating liquid used in this embodiment is a treatment liquid for coagulating a pigment, which is a color material of the ink. Specific composition is as follows:

Calcium nitrate tetrahydrate: 10%

Glycerin: 42%

Surfactant: 1%

Water: Remaining amount

Moreover, the viscosity of the above coating liquid is 5 to 6 cP (centipoise) at 25° C. In application of the present invention, it is needless to say that the coating liquid is not limited to the above. For example, a liquid containing a component for insolubilize or coagulate a dye can be used as another coating liquid.

In this embodiment, by using the treatment liquid as the coating liquid, coagulation of the pigment is accelerated by making the treatment liquid and the pigment, which is a color material of the ink ejected onto the printing medium coated with this treatment liquid, react on each other. Then, by accelerating the coagulation of the pigment, printing density can be improved. Moreover, reduction or prevention of bleeding can be also done. It is needless to say that the coating liquid used in the ink-jet printing apparatus is not limited to the above example.

When water is used in the coating liquid, slide characteristic at the contact portion between the coating roller and the liquid holding member of the present invention becomes favorable by adding a component to lower surface tension in the above liquid. In the above example of the components of the liquid for applying, glycerin and surfactant are the components to lower the surface tension of water.

Control System

Figure 24:
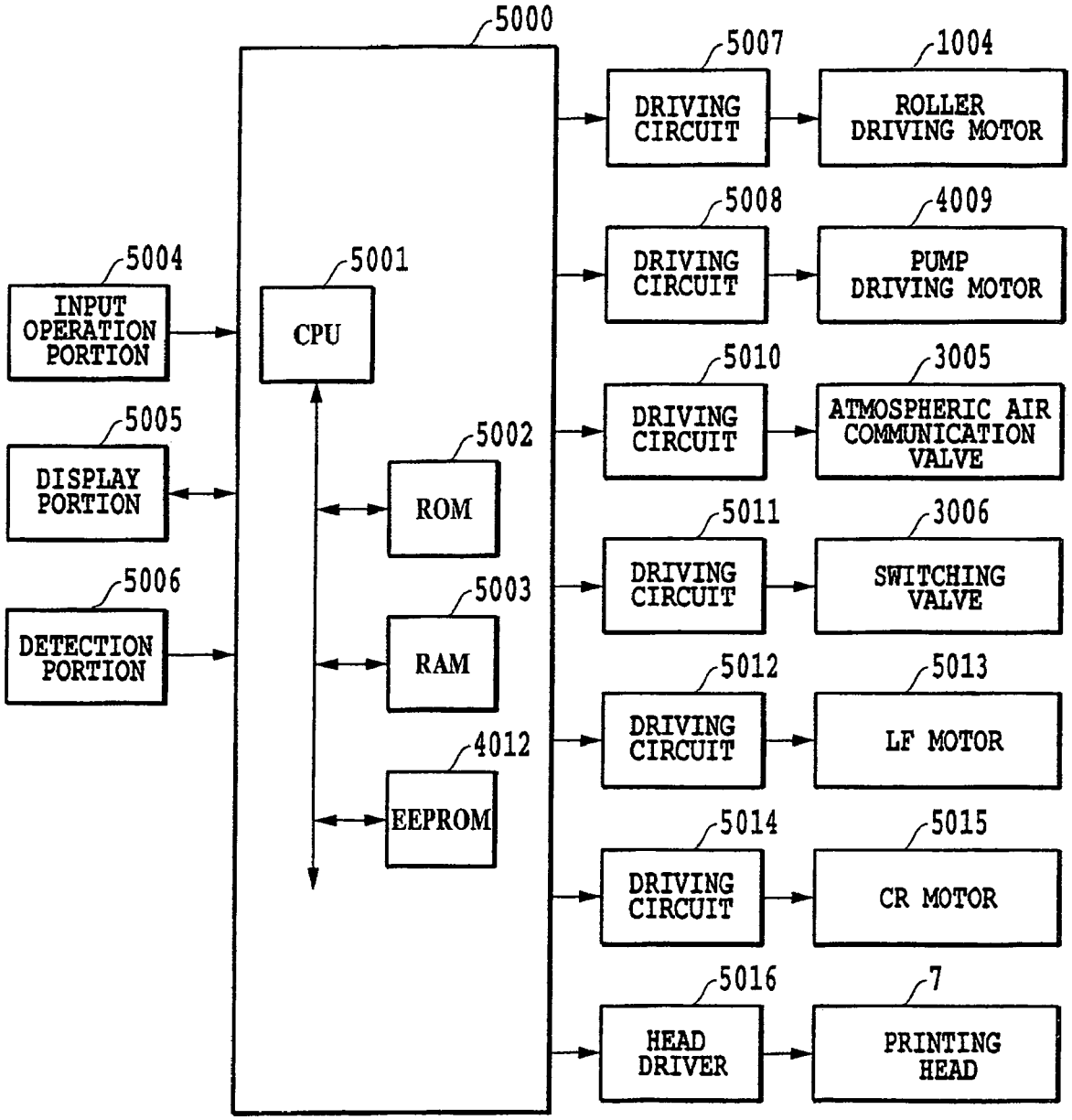
FIG. 24 is a block diagram showing an outline configuration of a control system according to the fifth embodiment.

FIG. 24 is a block diagram showing an outline configuration of a control system in the ink-jet printer of this preferred embodiment.

As shown in the figure, the mechanism and the control of the driving mechanism for the coating roller and pump driving and valve switching of the liquid flow paths are the same as those in the configuration shown in FIG. 12. Differences are that a CPU 5001 controls driving of each element of the coating mechanism according to a program of a processing procedure, which will be described later in FIG. 25 in this embodiment. The CPU 5001 also controls driving of an LF motor 5013, a CR motor 5015 and the printing head 7, which relate to a printing mechanism, via respective driving circuits 5012, 5014 and a head driver 5016. More specifically, the conveying roller 4 is rotated by driving of the LF motor 5013, and a carriage on which the printing head 7 is mounted is moved by driving of the CRmotor. Moreover, control to eject ink from nozzles of the printing head is performed.

Figure 25:
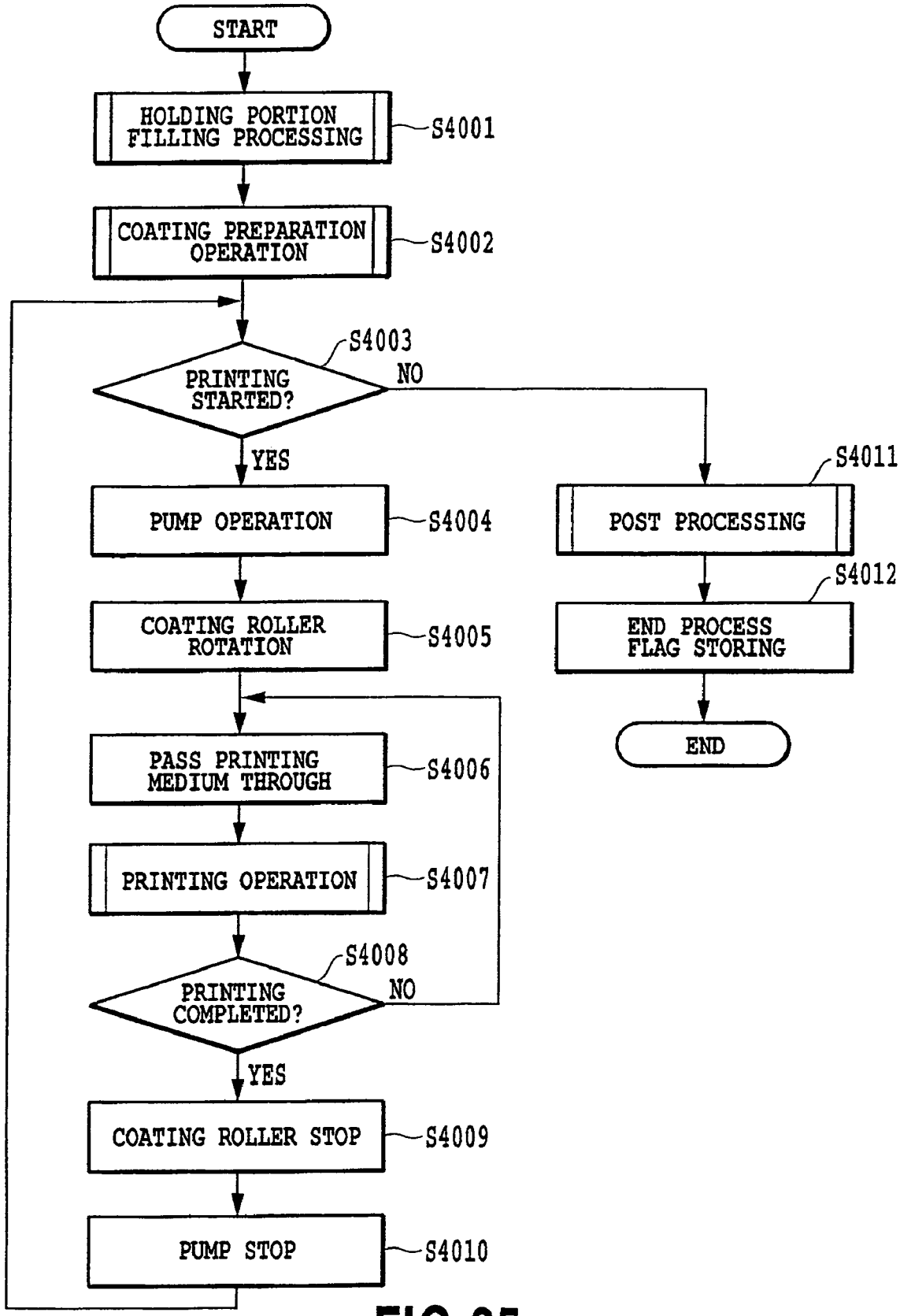
FIG. 25 is a flowchart showing a procedure of liquid applying and printing operation of the ink-jet printer according to the fifth preferred embodiment.

FIG. 25 is a flowchart showing a procedure of liquid coating in the ink-jet printer and printing operation involved in it of this embodiment.

When the printer is powered on, the control section 5000 executes the following sequence of coating operation and printing operation according to the flowchart shown in FIG. 25.

[Filling Process]

At Step S4001, filling of the coating liquid to the liquid holding space S is carried out. This filling process is the same as the filling process (Step S1) shown in FIG. 13. That is, control of filling operation such as determination of the end process flag and pump driving based on the determination is performed according to any one of the above-mentioned embodiments of the present invention.

[Coating Preparation Operation]

When the filling operation is finished, coating preparation operation is performed (Step S4002). That is, control of the preparation operation such as determination of the end process flag and rotation driving of the coating roller based on the determination is performed according to any one of the above-mentioned embodiments of the present invention.

[Coating Process]

When a printing start command is inputted (Step S4003), an operation of the pump 3007 is started again (Step S4004), and the coating roller 1001 starts to rotate clockwise in FIG. 23 (Step S4005). And by this rotation of the coating roller 1001, the coating liquid filled in the liquid holding space S adheres to the circumferential surface of the coating roller 10001 as if forming a film. The coating liquid adhering to the coating roller 1001 is fed to a portion where the coating roller 1001 is in contact with the counter roller 1002 via the printing medium P.

With this operation, the printing medium is conveyed by the printing medium feed mechanism 1006 to a portion between the coating roller 1001 and the counter roller 1002, and the printing medium is inserted between these rollers (Step S4006).

During the conveyance of the printing medium, the coating liquid applied on the circumferential surface of the coating roller is transferred to the printing medium P from the coating roller 1001. It is needless to say that a mechanism to supply the printing medium between the coating roller 1001 and the counter roller 1002 is not limited to the above feed mechanism. For example, a mechanism by manual insertion using a predetermined guide member as supplementary means may be used together, a configuration using the manual insertion mechanism alone or any other mechanism may be used.

As mentioned above, a coated portion of the printing medium P is conveyed to a portion on the platen 6 by a conveying force of the coating roller 2001. With this operation, an uncoated portion of the printing medium P is conveyed to a contact portion between the printing medium P and the coating roller 2001. Thus the coating liquid is applied to the whole printing medium by performing these operations continuously or intermittently.

[Printing Process]

After the above-mentioned coating process, printing operation is performed on the printing medium on which the coating liquid is applied at required portions (Step S4007). More specifically, the printing head 7 is scanned for the printing medium P which is conveyed by the conveying roller 4 by a predetermined amount, and the ink is ejected from the nozzle according to the printing data during this scanning so that the ink lands to the printing medium and forms dots. Since the landed ink reacts with the coating liquid, density improvement and bleeding prevention can be realized. By repeating the above conveyance of the printing medium and scanning by the printing head, printing is made on the printing medium P, and the printing medium for which printing has been finished is discharged onto the paper discharge tray 10.

More specifically, the coating roller carries out a predetermined amount of rotation intermittently and performs coating to the printing medium sequentially while changing the coating areas. With this operation, the conveying roller for conveying the printing medium similarly carries out a predetermined amount of rotation intermittently, and then printing is performed sequentially while changing the ink ejection area on the printing medium. Accordingly, when the ink is ejected for printing from the printing head to a first area of the printing medium, which is located on the downstream side of the printing medium in the conveying direction, the coating roller performs coating to a second area of the printing medium on the upstream side of the printing medium in the conveying direction. In this case, an intermittent conveying amount of the coating roller is the same as the intermittent conveying amount of the conveying roller. In this configuration, the conveying path for conveying the printing medium on which the liquid is applied by the coating roller to a position opposite to the above printing head has a length of the conveying path from the coating roller to the printing head, and the length is shorter than the maximum length of the printing medium which can be used in this printing apparatus.

In this embodiment, sequential printing is performed to a portion on which coating has been finished with liquid coating to the printing medium. That is, the length of the conveying path from the coating roller to the printing head is shorter than the length of the printing medium, and when the portion coated with the liquid on the printing medium reaches the area to be scanned by the printing head, coating is performed by the coating mechanism on the other portion of the printing medium. In this configuration, liquid applying and printing are performed sequentially on different portions of the printing medium per predetermined amount of conveyance of the printing medium. However, in application of the present invention, as described in Japanese Patent Application Laid-open No. 2002-096452 as another configuration, printing may be performed after coating on one printing medium is completed. In this configuration, the printing medium is conveyed to a position opposite to the printing head after the whole surface of the printing medium is coated by the coating roller and then, the ink is ejected and printing is started.

[End Process]

When coating and printing operations to the printing medium are executed as above, it is determined if the printing process may be finished or not (Step S4008). If the printing process is not to be finished, the process returns to Step S4006, and the coating operation and the printing operation according to the coating operation are repeated until the coating process on all the portions requiring coating of the printing medium is finished. When the printing process is finished, the coating roller 1001 is stopped (Step S4009) and driving of the pump 3007 is also stopped (Step S4010). After that, the process goes on to Step S4003, and if a new printing start command has been inputted to the next printing medium before a predetermined period of time has elapsed, the operations in the above Steps S4003 to S4010 are repeated. On the other hand, if the printing start command has not been inputted even after the predetermined period of time has elapsed, post processing such as the recovering operation to recover the coating liquid from the holding space S and the liquid flow paths is performed (Step S4011). After that, the end process flag is stored in the EEPROM 4012 (Step S4012), the processing is finished.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-233271, filed Aug. 11, 2005, which is hereby incorporated by reference herein in its entirety.

What is claimed is:

1. A liquid applying apparatus comprising:

an applying unit which includes a coating member for applying a liquid to a medium and a liquid holding member for holding the liquid in a condition that the liquid contacts with a part of the coating member, and causes the coating member to rotate so as to apply the liquid held by the liquid holding member to the medium through the coating member;

a reservoir which stores the liquid;

a path which makes the reservoir and the liquid holding member communicated with each other;

a recovering unit which recovers the liquid from a flow passage including said path and the liquid holding member to said reservoir;

a storage unit which stores information indicating that a recovering operation has been executed by said recovering unit; and a preparation operation executing unit which executes, as a preparation operation executed before applying operation by said applying unit, at least one of a supplying operation in which the liquid is supplied from said reservoir to the liquid holding member through said path and a rotation operation in which the coating member is rotated, wherein said preparation operation executing unit changes a mode of the preparation operation in accordance with a judgment whether the information indicating that a recovering operation has been executed is stored in said storage unit.

2. A liquid applying apparatus comprising:

an applying unit which includes a coating member for applying a liquid to a medium and a liquid holding member for holding the liquid in a condition that the liquid contacts with a part of the coating member, and causes the coating member to rotate so as to apply the liquid held by the liquid holding member to the medium through the coating member;

a reservoir which stores the liquid;

a first path for supplying the liquid stored in said reservoir to the liquid holding member;

a second path for recovering the liquid from liquid holding member to said reservoir;

a recovering unit which recovers the liquid from a flow passage including said first, second paths and the liquid holding member to said reservoir;

a storage unit which stores information indicating that a recovering operation has been executed by said recovering unit; and an executing unit which executes a supplying operation in which the liquid is supplied from said reservoir to the liquid holding member through said first path, before applying operation by said applying unit, wherein said executing unit changes a mode of the supplying operation in accordance with a judgment whether the information indicating that a recovering operation has been executed is stored in said storage unit.

3. A liquid applying apparatus comprising:

an applying unit including a coating member for applying a liquid to a medium and a liquid holding member for holding the liquid in a condition that the liquid contacts with a part of the coating member, and causing the coating member to rotate so as to apply the liquid held by the liquid holding member to the medium through the coating member;

a reservoir which stores the liquid;

a first path for supplying the liquid stored in said reservoir to the liquid holding member;

a second path for transferring the liquid held in the liquid holding member to said reservoir a recovering unit which recovers the liquid from a flow passage including said first, second paths and the liquid holding member to said reservoir;

a storage part unit which stores information indicating that a recovering operation has been executed by said recovering unit; and an executing unit which executes a rotating operation in which the coating member is rotated, before applying operation by said applying unit, wherein said executing unit changes a mode of the rotating operation in accordance with a judgment whether the information indicating that a recovering operation has been executed is stored in said storage unit.

4. A liquid applying apparatus as claimed in claim 1, wherein said preparation operation executing unit makes operation time of a pump for executing the supplying operation when the information is not stored in said storage unit longer than that when the information is stored, in the case that the supplying operation is executed as the preparation operation.

5. A liquid applying apparatus as claimed in claim 1, wherein said preparation operation executing unit makes time for rotation of the coating member when the information is not stored in said storage unit longer than that when the information is stored, in the case that the rotation operation is executed as the preparation operation.

6. A liquid applying apparatus as claimed in claim 1, wherein said preparation operation executing unit makes driving speed of a pump for executing the supplying operation when the information is not stored in said storage unit greater than that when the information is stored, in the case that the supplying operation is executed as the preparation operation.

7. A liquid applying apparatus as claimed in claim 1, wherein said preparation operation executing unit makes rotation speed of the coating member when the information is not stored in said storage unit greater than that when the information is stored, in the case that the rotation operation is executed as the preparation operation.

8. A liquid applying apparatus as claimed in claim 1, wherein said preparation operation executing unit makes a number of times of driving of a pump for executing the supplying operation when the information is not stored in said storage unit larger than that when the information is stored, in the case that the supplying operation is executed as the preparation operation.

9. A liquid applying apparatus as claimed in claim 1, wherein said preparation operation executing unit makes a number of times of the rotation of the coating member when the information is not stored in said storage unit greater than that when the information is stored, in the case that the rotation operation is executed as the preparation operation.

10. A liquid applying apparatus comprising:

an applying unit which includes a coating member for applying a liquid to a medium and a liquid holding member for holding the liquid in a condition that the liquid contacts with a part of the coating member, and causes the coating member to rotate so as to apply the liquid held by the liquid holding member to the medium through the coating member;

a reservoir which stores the liquid;

a path which makes the reservoir part and the liquid holding member communicated with each other;

a recovering unit which recovers the liquid from a flow passage including said path and the liquid holding member to said reservoir;

a storage unit which stores information indicating that a recovering operation has been executed by said recovering unit; and a preparation operation executing unit which executes a predetermined preparation operation before applying operation by said applying unit if the information indicating that a recovering operation has been executed is not stored in said storage unit, wherein the predetermined preparation operation is one of (A) a supplying operation in which the liquid is supplied from said reservoir to the liquid holding member through said path and (B) a rotation operation in which the coating member is rotated.

11. An ink jet printing apparatus comprising:

a liquid applying apparatus according to claim 1; and a printing head which ejects an ink on the medium to which the liquid has been applied by said liquid applying apparatus.

* * * * *